US009711844B2

(12) United States Patent
Pryor et al.

(10) Patent No.: US 9,711,844 B2
(45) Date of Patent: Jul. 18, 2017

(54) PORTABLE ANTENNA

(71) Applicant: Leonardo MW Ltd, Basildon (GB)

(72) Inventors: Neil Pryor, Bristol (GB); David Atkins, Bristol (GB); David Hall, Bristol (GB)

(73) Assignee: LEONARDO MW LTD, Essex (GB)

( * ) Notice: Subject to any disclaimer, the term of this patent is extended or adjusted under 35 U.S.C. 154(b) by 0 days.

(21) Appl. No.: 14/654,989

(22) PCT Filed: Dec. 9, 2013

(86) PCT No.: PCT/EP2013/075996
§ 371 (c)(1),
(2) Date: Jun. 23, 2015

(87) PCT Pub. No.: WO2014/102058
PCT Pub. Date: Jul. 3, 2014

(65) Prior Publication Data

US 2015/0333391 A1 Nov. 19, 2015

(30) Foreign Application Priority Data

Dec. 24, 2012 (GB) ..... 1223396.1
Dec. 24, 2012 (GB) ..... 1223398.7
(Continued)

(51) Int. Cl.
*H01Q 1/12* (2006.01)
*H01Q 1/27* (2006.01)
(Continued)

(52) U.S. Cl.
CPC ..... *H01Q 1/273* (2013.01); *H01Q 1/08* (2013.01); *H01Q 1/084* (2013.01); *H01Q 1/088* (2013.01);
(Continued)

(58) Field of Classification Search
CPC ..... H01Q 1/273; H01Q 1/243; H01Q 17/00; H01Q 1/06
(Continued)

(56) References Cited

U.S. PATENT DOCUMENTS 3,568,201 A 3/1971 Spoonamore
3,579,244 A 5/1971 Dempsey
(Continued)

FOREIGN PATENT DOCUMENTS

EP 0777296 A1 6/1997
EP 0791878 A2 8/1997
(Continued)

OTHER PUBLICATIONS

Examination Report under Section 18(3) issued on Aug. 3, 2015, by the Great Britain Intellectual Property Office in corresponding Great Britain Patent Application No. 1321760.9 (2 pgs).
(Continued)

*Primary Examiner* — Joseph Lauture
(74) *Attorney, Agent, or Firm* — Buchanan Ingersoll & Rooney PC

(57) ABSTRACT

A portable antenna with a housing in which the antenna is held when not in use, and a mechanism to cause the antenna to pop-up from, and sit on top of, the housing when it is to be used. The mechanism can function to collapse the antenna into the housing when not in use.

20 Claims, 27 Drawing Sheets

(30) Foreign Application Priority Data

Dec. 24, 2012 (GB) ..... 1223399.5
Dec. 24, 2012 (GB) ..... 1223400.1

(51) Int. Cl.

| | |
|---|---|
| ***H01Q 1/08*** | (2006.01) |
| ***H01Q 1/48*** | (2006.01) |
| ***H01Q 9/16*** | (2006.01) |
| ***H01Q 19/30*** | (2006.01) |
| ***H01Q 21/24*** | (2006.01) |
| ***H01Q 21/26*** | (2006.01) |
| *H01Q 7/00* | (2006.01) |
| *H01Q 1/24* | (2006.01) |
| *H01Q 1/06* | (2006.01) |

(52) U.S. Cl.
CPC ..... *H01Q 1/1235* (2013.01); *H01Q 1/48* (2013.01); *H01Q 9/16* (2013.01); *H01Q 19/30* (2013.01); *H01Q 21/24* (2013.01); *H01Q 21/26* (2013.01); *H01Q 1/06* (2013.01); *H01Q 1/243* (2013.01); *H01Q 7/00* (2013.01)

(58) Field of Classification Search
USPC ..... 343/718, 702, 721, 742, 797
See application file for complete search history.

(56) References Cited

U.S. PATENT DOCUMENTS

| | | | | |
|---|---|---|---|---|
| 3,665,478 | A | 5/1972 | Dempsey | |
| 4,249,185 | A | 2/1981 | De Cesari | |
| 5,166,695 | A | 11/1992 | Chan et al. | |
| 5,497,506 | A | 3/1996 | Takeyasu | |
| 5,576,719 | A | 11/1996 | Gerszberg et al. | |
| 5,684,672 | A | 11/1997 | Karidis et al. | |
| 5,838,280 | A | 11/1998 | Miyashita | |
| 6,429,817 | B1 | 8/2002 | Creigh et al. | |
| 2008/0088523 | A1 | 4/2008 | Packer et al. | |
| 2010/0171677 | A1 | 7/2010 | Rakotoarisoa | |
| 2011/0074644 | A1 | 3/2011 | Wertman et al. | |
| 2011/0221646 | A1 | 9/2011 | Dresel et al. | |
| 2012/0280869 | A1* | 11/2012 | Kirkham ..... | H01Q 1/084 343/718 |

FOREIGN PATENT DOCUMENTS

| | | | |
|---|---|---|---|
| EP | 2015393 | A1 | 1/2009 |
| GB | 1268344 | | 3/1972 |
| GB | 1448999 | A | 9/1976 |
| GB | 2309830 | A | 8/1997 |
| GB | 2410646 | A | 8/2005 |
| GB | 2413013 | A | 10/2005 |
| GB | 2456808 | A | 7/2009 |
| JP | 08-279708 | A | 10/1996 |
| JP | 2004-304541 | A | 10/2004 |
| UA | 24 286 | U | 6/2007 |

OTHER PUBLICATIONS

International Search Report (PCT/ISA/210) mailed on Apr. 17, 2014, by the European Patent Office as the International Searching Authority for International Application No. PCT/EP2013/075991.

Written Opinion (PCT/ISA/237) mailed on Apr. 17, 2014, by the European Patent Office as the International Searching Authority for International Application No. PCT/EP2013/075991.

GB Search Report issued Jul. 14, 2014 for Application No. GB1321860.7.

International Search Report (PCT/ISA/210) mailed on Apr. 17, 2014, by the European Patent Office as the International Searching Authority for International Application No. PCT/EP2013/075995.

Written Opinion (PCT/ISA/237) mailed on Apr. 17, 2014, by the European Patent Office as the International Searching Authority for International Application No. PCT/EP2013/075995.

GB Search Report issued on Jul. 15, 2014 Application No. GB1321759.1.

International Search Report (PCT/ISA/210) mailed on Apr. 17, 2014, by the European Patent Office as the International Searching Authority for International Application No. PCT/EP2013/075996.

GB Search Report issued on Jul. 15, 2014 Application No. GB1321760.9.

Atkins, "A review of the practical limitations of designing antennas for portable applications", Antennas and Propagation (EUCAP), 2010 Proceedings of the Fourth European Conference on, IEEE, Piscataway, NJ, USA, Apr. 12, 2010, pp. 1-2, XP031705884.

* cited by examiner

PORTABLE ANTENNA

The present invention relates to a portable antenna and in particular but not limited to a satellite communications antenna designed to be operated whilst carried by a user.

Typically one soldier of a unit on field patrol carries a radio which operates in conjunction with an antenna to provide satellite communication between the unit and a base.

One type of antenna used for satellite communication is of pistol grip form. It is designed to be held in the user's hand and pointed in the direction of the satellite. Pistol grip antenna are not well suited for combat use as it is preferred that both hands of the solider are free to operate a weapon.

Other antenna have been mounted to the soldier's rucksack to keep the soldier's hands free. When erected, the antenna's radial driven members cause the antenna to be unwieldy and liable to snag on passing objects which can lead to the antenna breaking.

Rucksack mounted antenna also make the solider, and consequently the unit as a whole, more conspicuous to the enemy.

These problems can be overcome by collapsing or dismantling the antenna when not in use, though this is time consuming and requires the solider to remove his rucksack each time the antenna is to be collapsed or assembled.

According to the invention there is provided a man-portable antenna assembly comprising: an antenna having at least one driven element mounted on a support; a housing in which the antenna is housed when stowed; and a mechanism to withdraw the antenna out from the housing when the antenna is to be used.

Through use of the invention the antenna quickly and easily erected from a stowed configuration within a housing when not in use.

It is preferred that the housing acts as a mast for the antenna when withdrawn out from the housing. This allows the antenna to be held higher and, when carried on a person, further away from them so as to improve reception.

Preferably the antenna is supported on an upper end of the housing when in use.

To make it more convenient to stow the antenna when not in use it is preferred that the mechanism is effective to withdraw the antenna into the housing when the antenna is to be stowed.

In a preferred embodiment, the driven element comprises an elongate member and the mechanism is effective to cause the elongate member to be extended away from or withdrawn towards the support. This allows the housing to be smaller than the width of the antenna when in an erect configuration.

For similar reasons it is also preferred that the man-portable antenna assembly has a ground plane comprising an elongate member and in which the mechanism is effective to cause the elongate member to be extended away from or withdrawn towards the support.

It is preferred that the mechanism comprises means which engage with the housing when the antenna is being withdrawn into the housing to cause the driven element to withdraw towards the support.

Similarly it is also preferred that the mechanism comprises means which engage with the housing when the antenna is being withdrawn into the housing to cause the ground plane to withdraw towards the support.

It is preferred that the driven element comprises elongate members which are foldably mounted to the support in order that they can fold away from or in towards the support. The elongate members of the ground member may also be foldably mounted to the support in order that they can fold away from or in towards the support.

It is preferred that the antenna comprises a bias (or biases) which causes the elongate members to fold outwardly away from the support when not retained in the housing. The bias may also acts to hold the elongate members in a radially extended orientation. This biasing force provided by the bias(es) may also act to preferentially support the antenna on top of the housing when erect.

It is preferred that the mechanism is operated by a pull-cord as this allows the mechanism to be operated remote from the antenna or housing It is preferred that both the driven element and the ground plane element are arranged to be collapsed towards the support into a stowed configuration; and a linkage between the driven element and ground plane element which causes, when one of the driven element or ground plane element is collapsed, to cause the other to also collapse.

It is preferred that the man-portable antenna assembly is suitable for use with a radio to enable satellite communication.

In a typically arrangement the man-portable antenna comprises two dipoles orientated substantially perpendicular to one another and at least four grounded radial elements which act as a reflector for the dipoles.

The invention will now be described by example with reference to the following drawings in which:

FIGS. 1-17 illustrate a portable antenna assembly 1 arranged for use with a radio (not shown) to allow satellite communication, e.g. through TACSAT and/or MUOS, to a command station.

Figure 1:
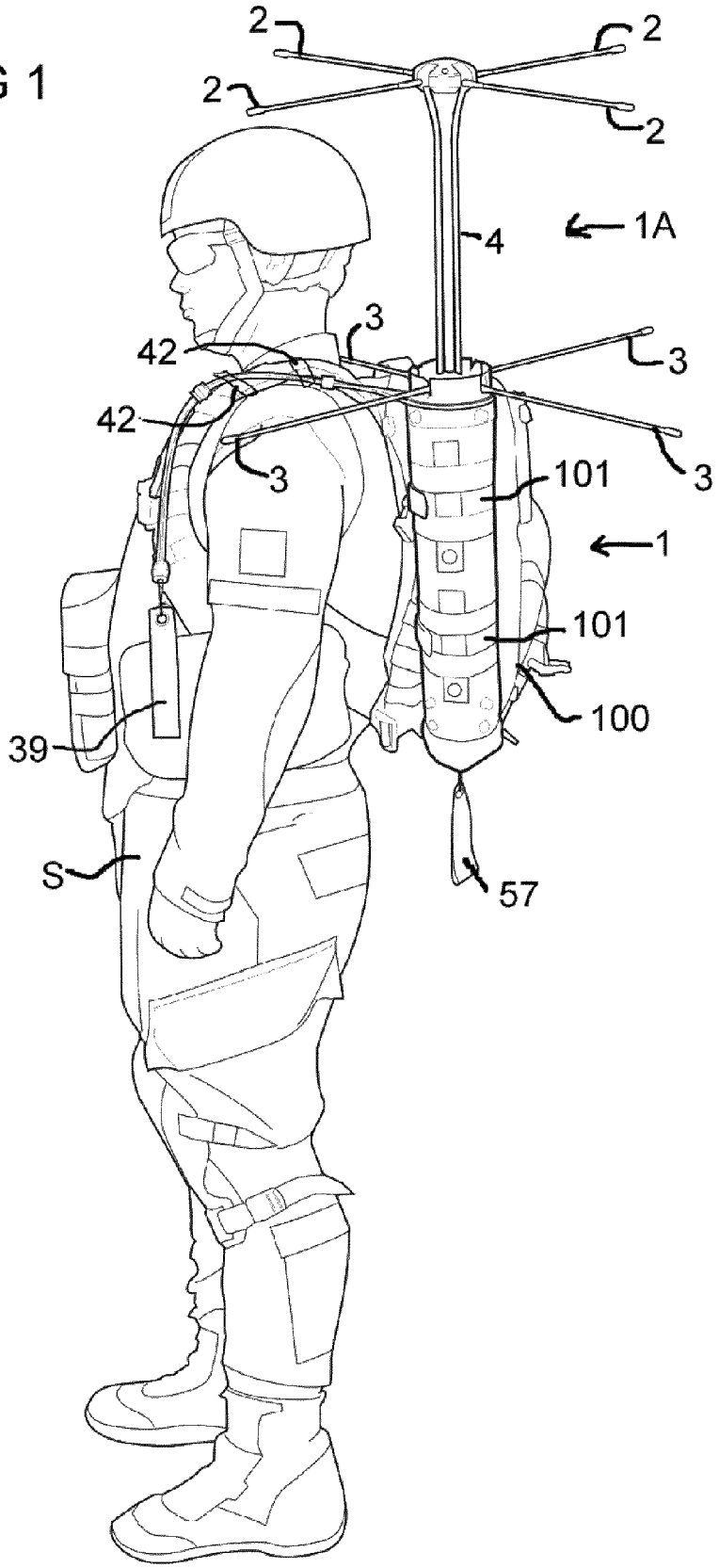
FIG. 1 is a perspective view of a deployed portable antenna assembly mounted to a rucksack carried by a solider.
Figure 2:
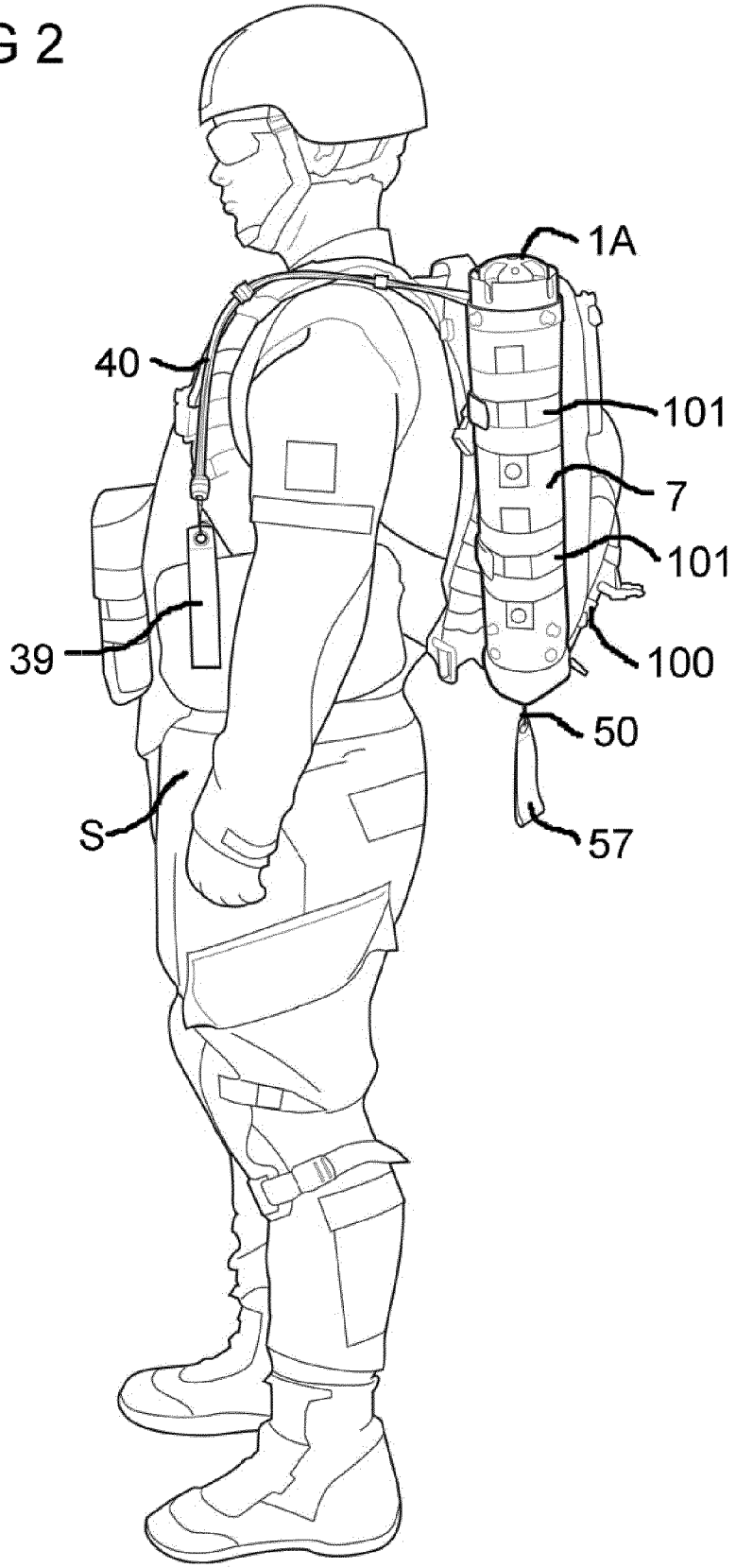
FIG. 2 is a perspective view of the portable antenna assembly mounted to a rucksack carried by a soldier in a stowed configuration.
Figure 3:
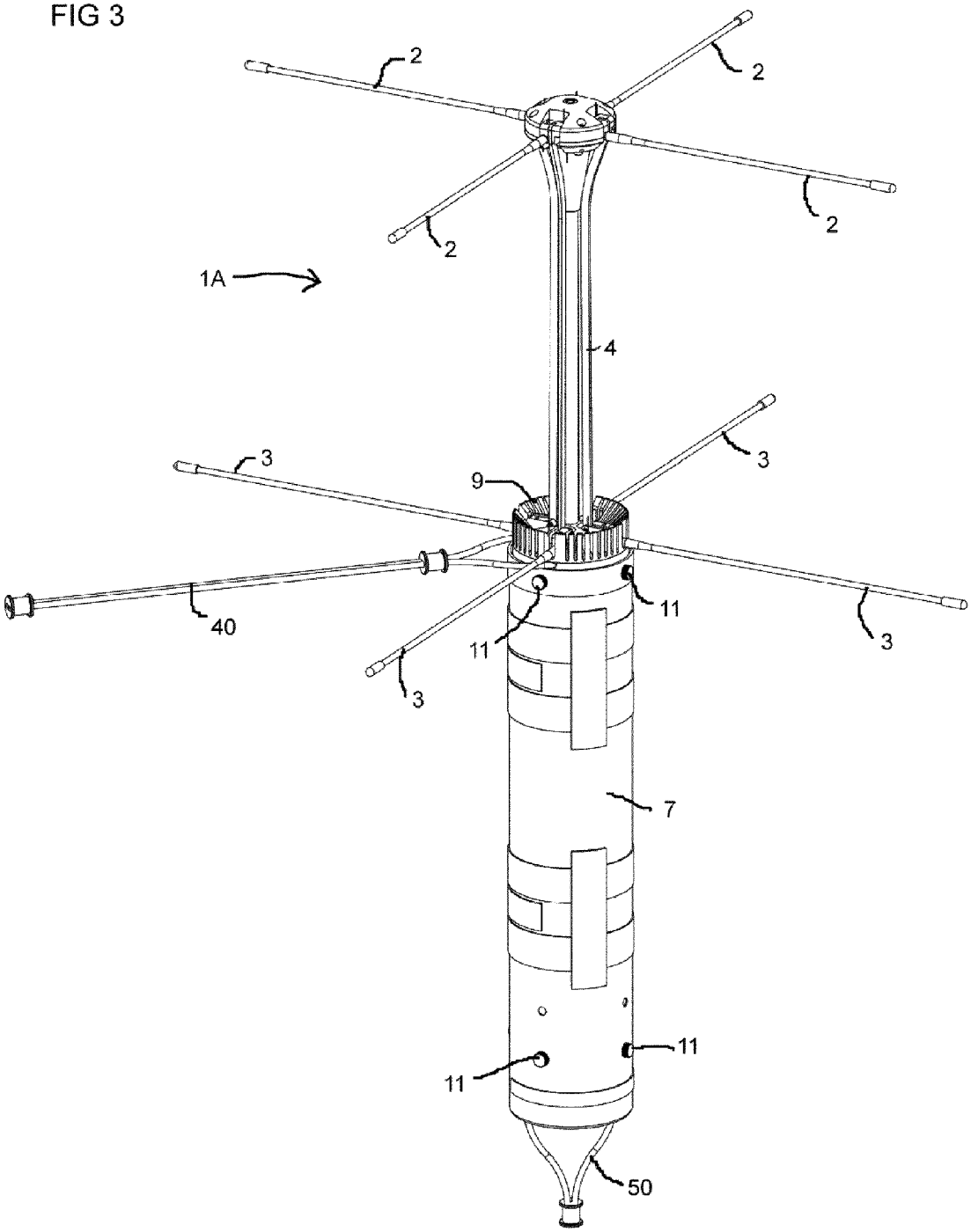
FIG. 3 is perspective view of the portable antenna assembly in a deployed configuration.
Figure 4:
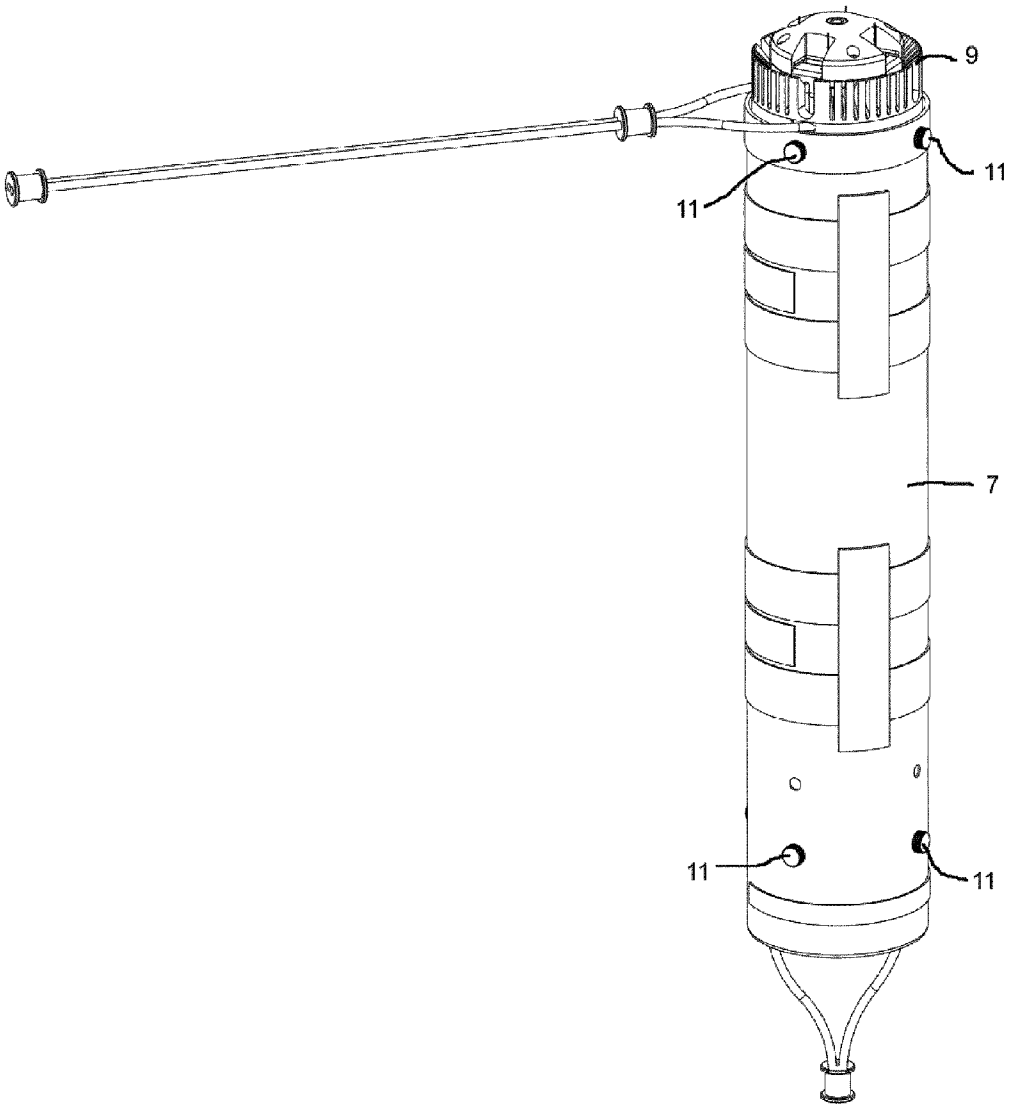
FIG. 4 is a perspective view of the portable antenna assembly in a stowed configuration.
Figure 16:
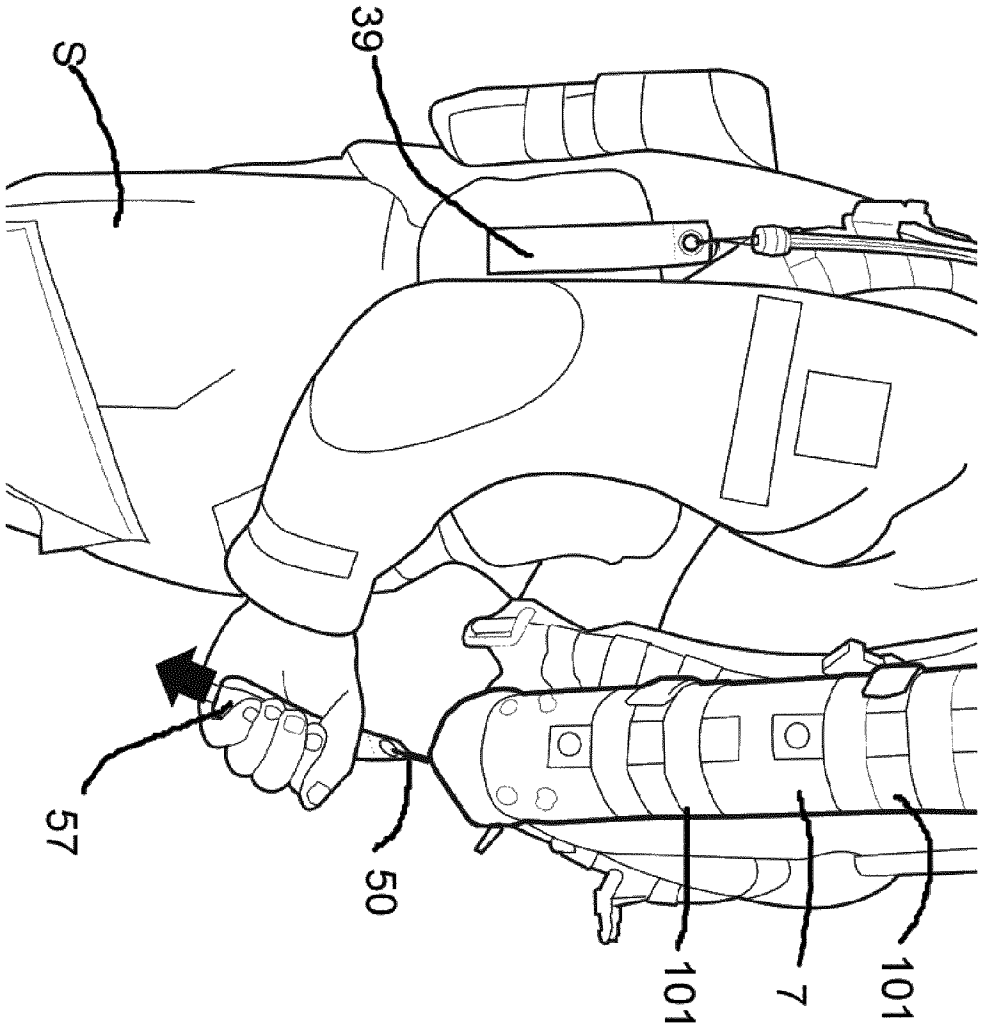
FIG. 16 is a perspective close up illustrating the lower pull cord being pulled to stow the antenna.
Figure 17:
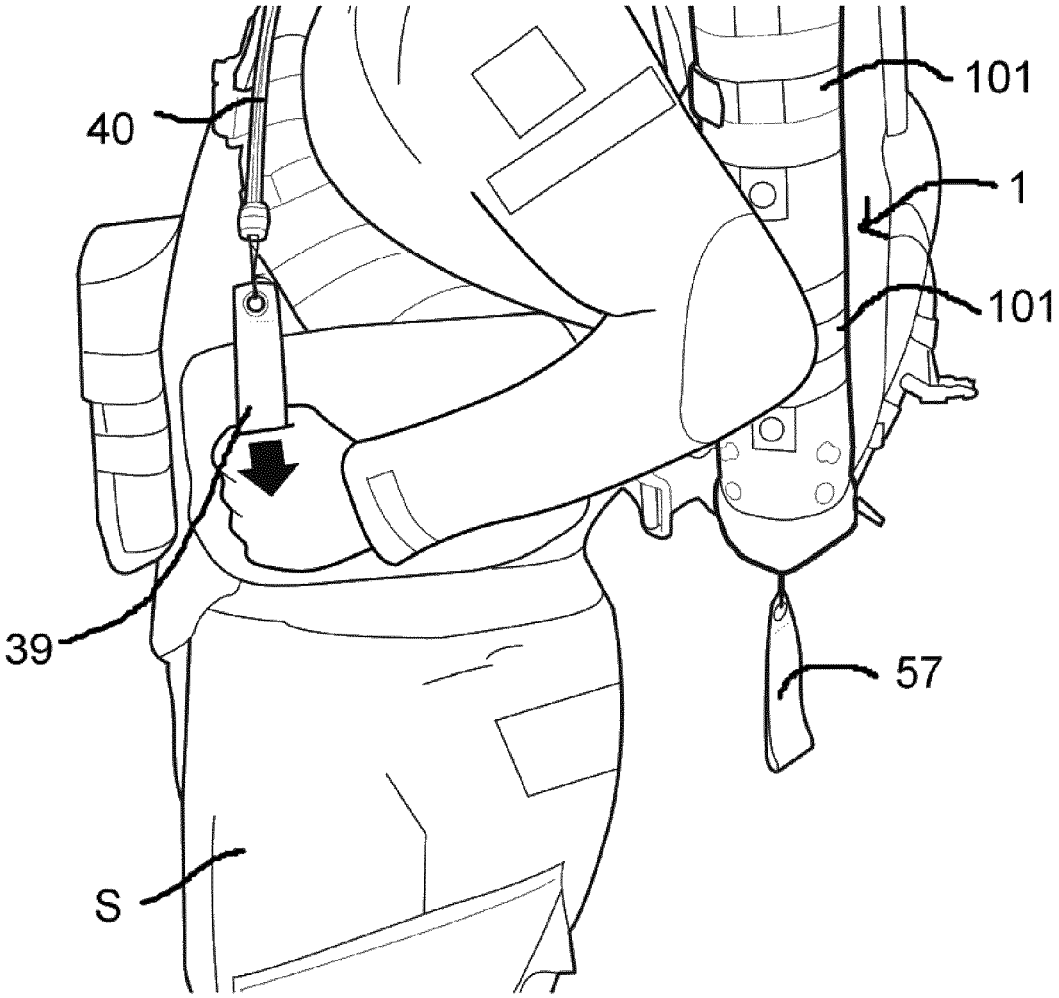
FIG. 17 is a perspective close up illustrating the upper pull cord being pulled to erect the antenna.

The antenna assembly 1 is designed to be carried on a soldier's S back, preferably mounted in or on a rucksack 100. FIGS. 1 and 2 illustrate an example in which the antenna assembly 1 is mounted against the side of the rucksack 100 using straps 101 with hook and loop fasteners. The soldier S can cause an antenna 1A to collapse into housing shown in FIG. 2 by pulling on handle 57 see FIG. 16, and conversely can erect the stowed antenna 1A by pulling on handle 39, see FIG. 17.

The antenna assembly 1 comprises an antenna 1A having driven elements 2 (two dipoles arranged perpendicular to one another) and a ground plane 3 that acts as a reflector for the dipoles. Both the driven elements 2 and ground plane 3 are mounted to a central supporting column 4.

Figure 11:
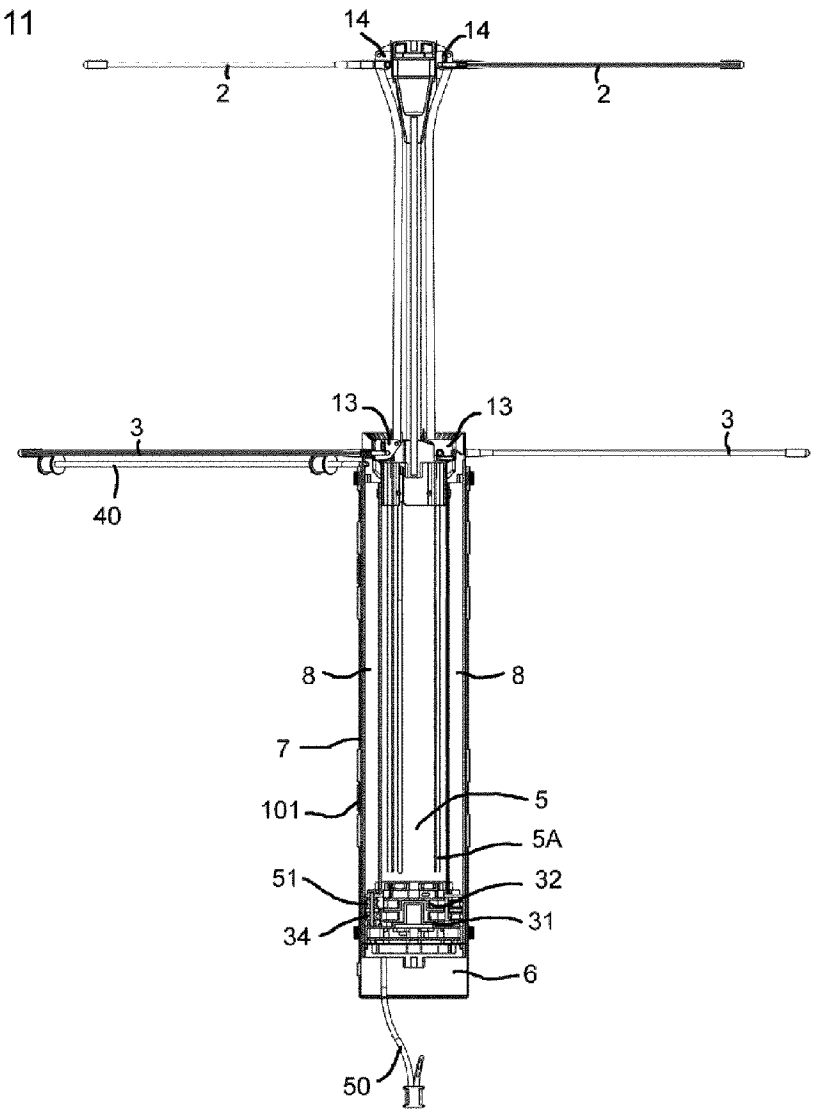
FIG. 11 is a side sectional view of the deployed antenna assembly.

The antenna assembly 1 further comprises a housing into which the antenna 1A can be stowed when not in use. The housing comprises an inner housing 5 (shown most clearly in FIG. 9) which holds the antenna 1A when stowed. A casing (preferably sealed) 6 mounted to the inner housing 5 holds circuitry for driving the antenna 1A. The inner housing 5 and casing 6 are housed within an outer housing 7. A spacing 8, shown in FIGS. 11 & 12, between the outer housing 7 and inner housing 5 carries coaxial cabling between the antenna 1A and the circuitry within casing 6. The space 8 also houses pull-cords 40, 50 forming part of the operational mechanism to be described later.

The outer housing 7, which is removable, is secured to an upper end cap 9 of the inner housing 5, by thumb screws 11 which locate into threaded apertures 12 defined by the end cap 9.

The two driven elements (dipoles) are comprised from four elongate members 2 that, when in an operating arrangement, extend radially away from the supporting column 4. Each is spaced circumferentially from the next by around 90 degrees.

The ground plane is similarly comprised from four elongate members 3 that extend radially away from the supporting column 4 when in an operating arrangement.

When erect, the driven elements 2 and ground plane members 3 are separated by a distance of substantially a quarter of a wavelength of the intended transmission wavelength as is well known in the art. The ground plane members 3 extend radially further outwards as compared to the driven members 2 so as to improve the transmission properties of the antenna 1A.

The elongate members forming the driven elements 2 and ground plane 3 are comprised from sprung steel (or other conductive material) covered with a synthetic plastics material. In some embodiments the protective casing may be omitted.

The elongate members may be releasably attached to the support. This may be achieved in a number of ways, examples including via a plug-in action similar to that used with an audio jack, or through a screw fitting. This allows any elongate member to be easily replaced should it break.

As illustrated in FIG. 1, the antenna assembly is orientated such that when the antenna 1A is deployed, two of the ground plane members 3 extend across, and may rest upon the shoulder's of the soldier S. The driven members 2 are preferably held above the soldier's S head.

Figure 5:
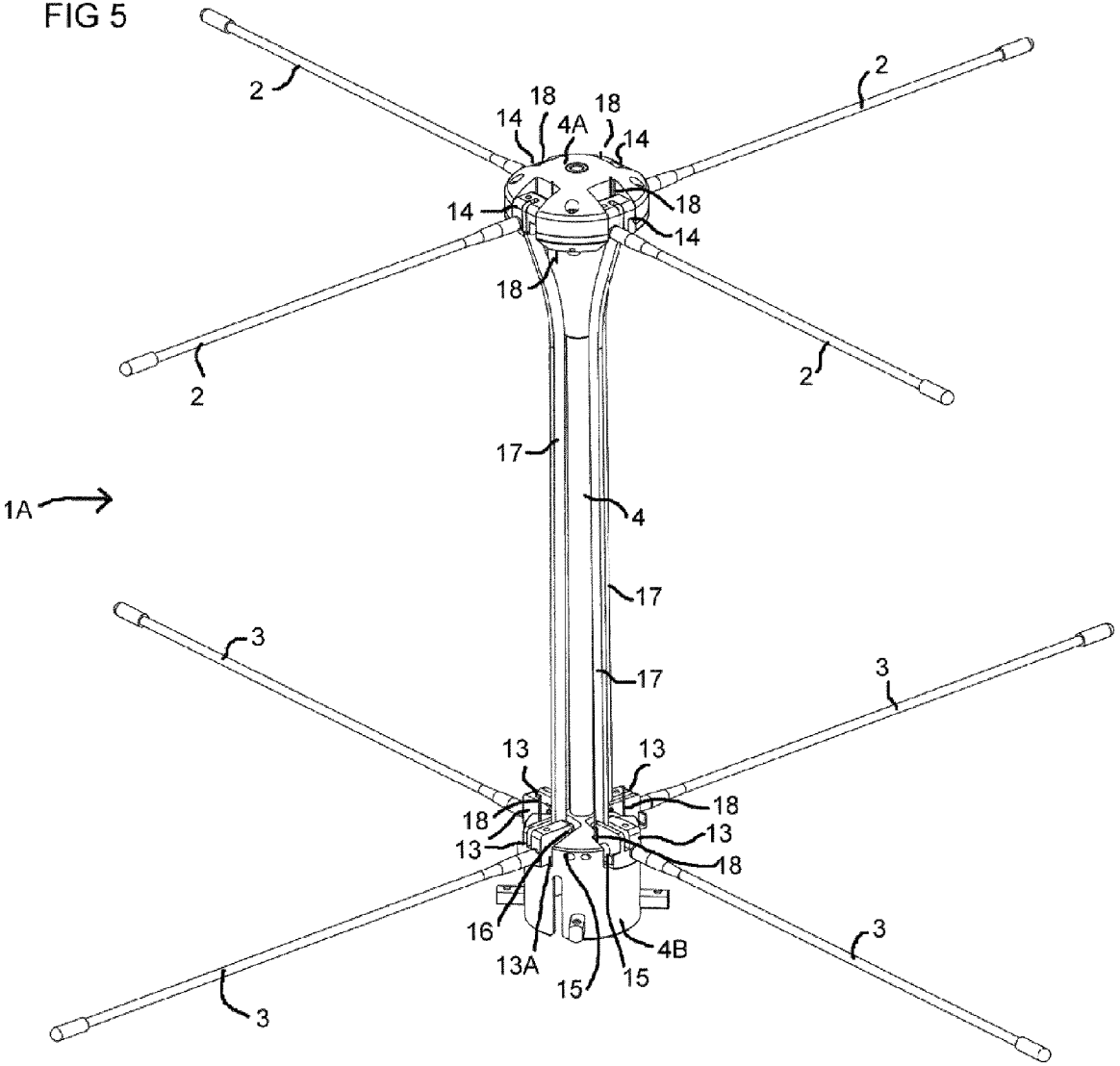
FIG. 5 is a perspective view of the antenna in a deployed configuration.
Figure 6:
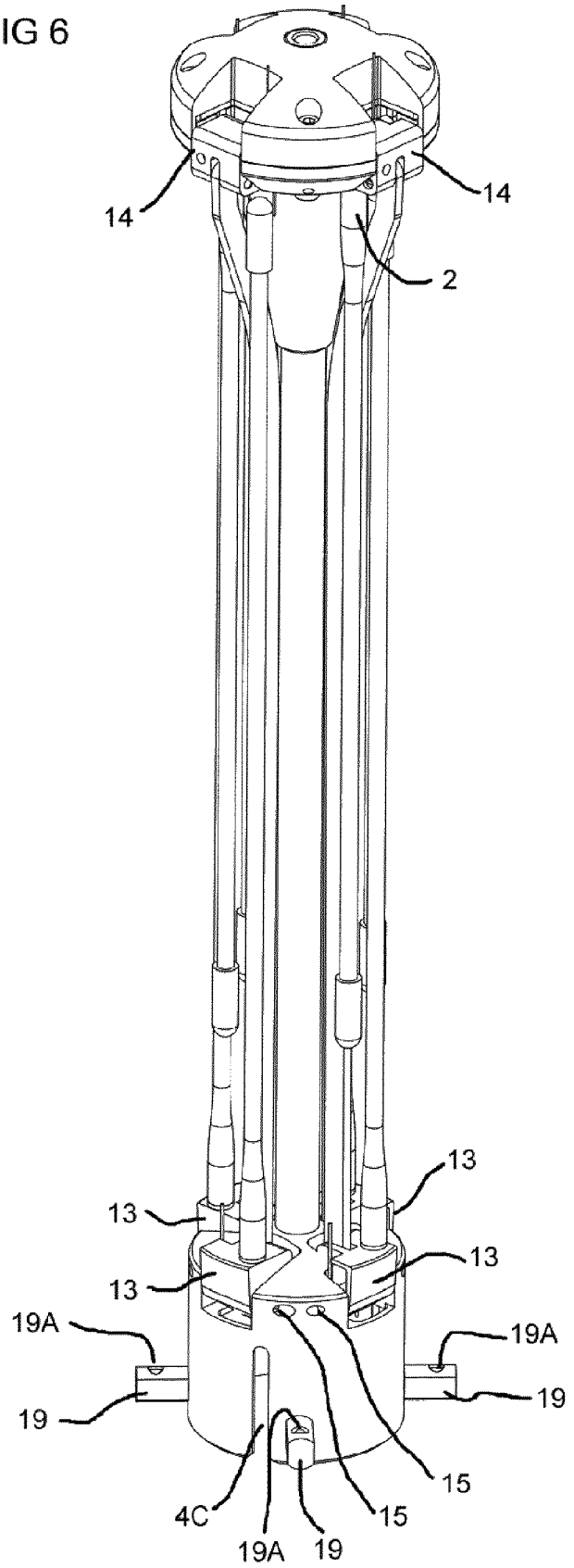
FIG. 6 is a perspective view of the antenna in a stowed configuration.
Figure 7:
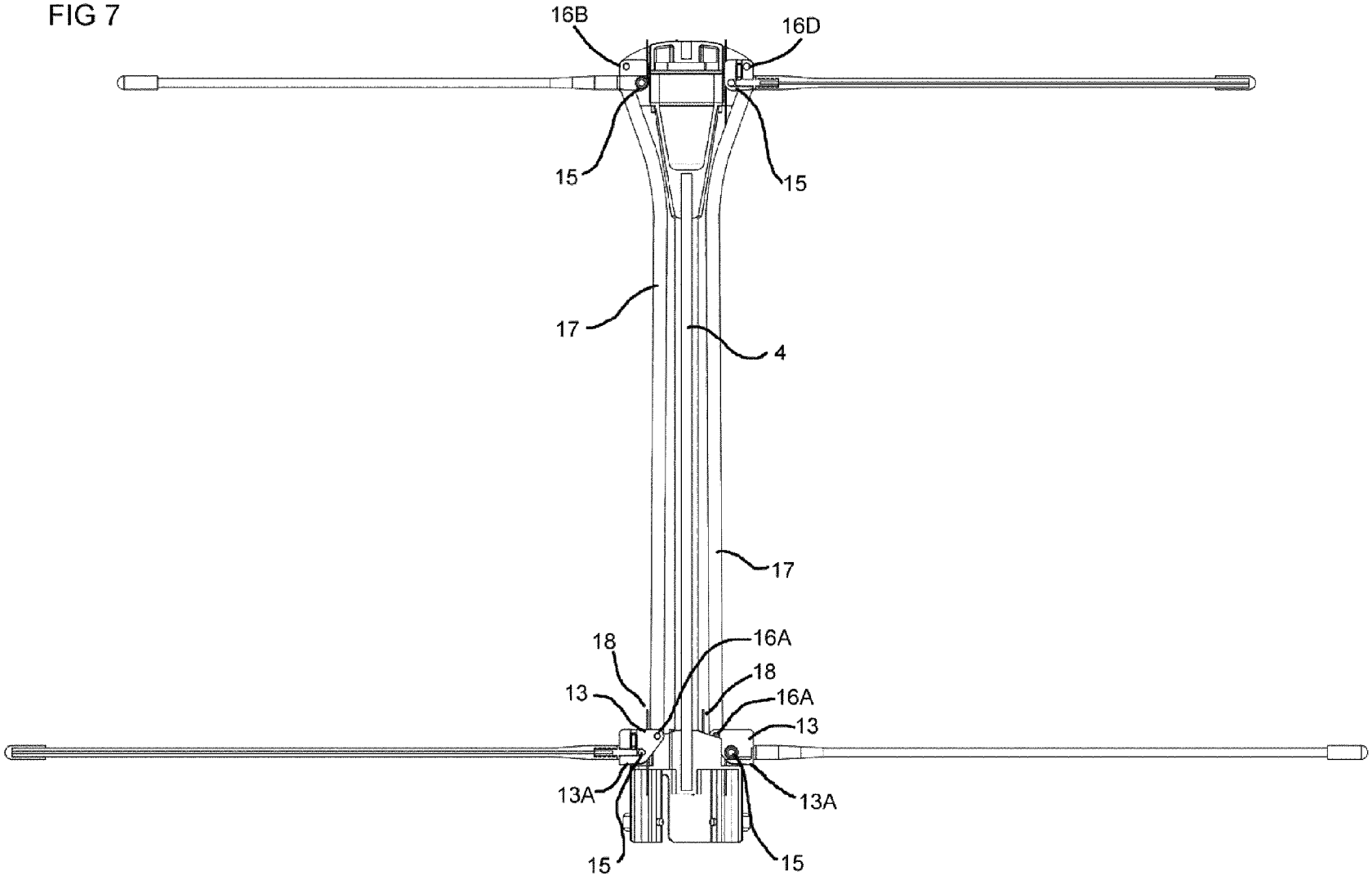
FIG. 7 is a side elevation of the antenna in a deployed configuration.

As illustrated in FIGS. 5-7, each ground plane member 3 and driven member 2 is counter levered about a knuckle; the ground plane members 3 to knuckles 13 and antenna members 2 to knuckles 14. Each knuckle 13, 14 is hinged about a mounting hinge 15 to either an upper mounting 4A or lower mounting 4B of the supporting column 4 which allows the each knuckle 13, 14 to rotate relative to the supporting column 4 about an axis substantially perpendicular to the main axis of the supporting column 4.

The knuckle 13 of each ground plane member 3 is hingedly connected at 16 through a link bar 17 to the knuckle 14 of the driven member 2 supported above it. As shown in FIG. 7, each link bar 17 is connected by hinge 16A to the ground plane knuckle 13 at a point radially inward of the mounting hinge 15. Conversely, the knuckle 14 of the driven member 2 is connected by hinge 16B to the link bar 17 at a point radically outward of the mounting hinge 15. Through this arrangement, rotation of a ground plane member knuckle 13 in one direction will cause the linked knuckle 14 of the driven member 2 above it to rotate in an opposite direction.

A torsion spring 18 sits over a mounting hinge 15 between each knuckle 13, 14 and the mounting 4A, 4B to the central supporting column 4. The torsion springs 18 act to bias the knuckles 13, 14 outwardly from the central supporting column 4 into the radial configuration shown in FIGS. 5 and 7. As also shown in these Figures, when in this configuration, a radially outward portion 13A of each ground plane knuckle 13 extends beyond the outer perimeter of the lower mounting 4B.

Figure 10:
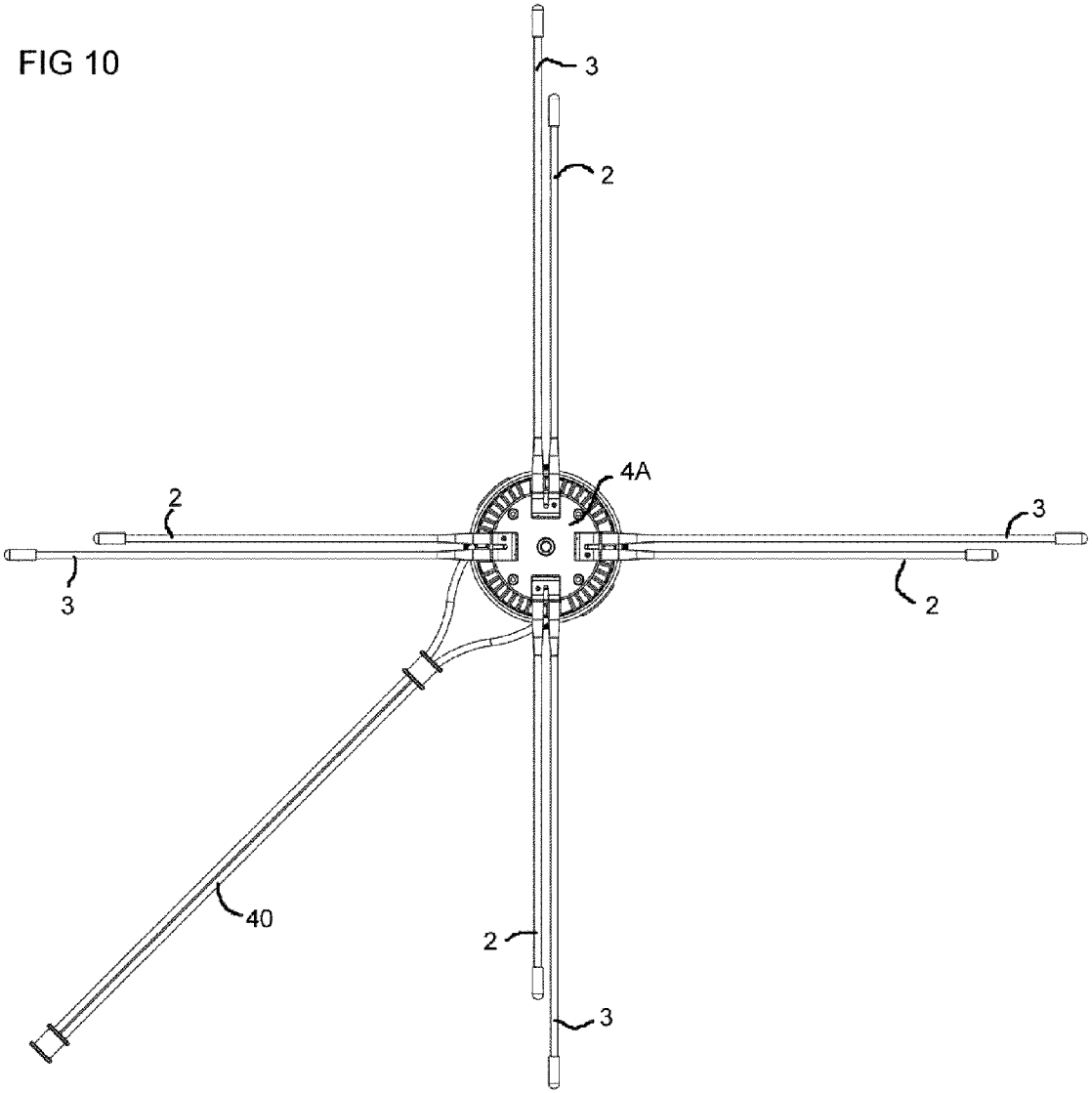
FIG. 10 is a plan view of the deployed antenna assembly.

In order that the driven members 2 and ground plane members 3 can fold inwardly towards the central support 4 without obstructing each other, they are arranged to be slightly offset from a vertical alignment as seen in FIG. 10. This is achieved, as shown in FIGS. 5 and 6, by mounting the driven members 2 on one side of the hinge 16B, and the ground plane members 3 to the knuckles 13 on the other side of the hinge 16B.

Figure 9:
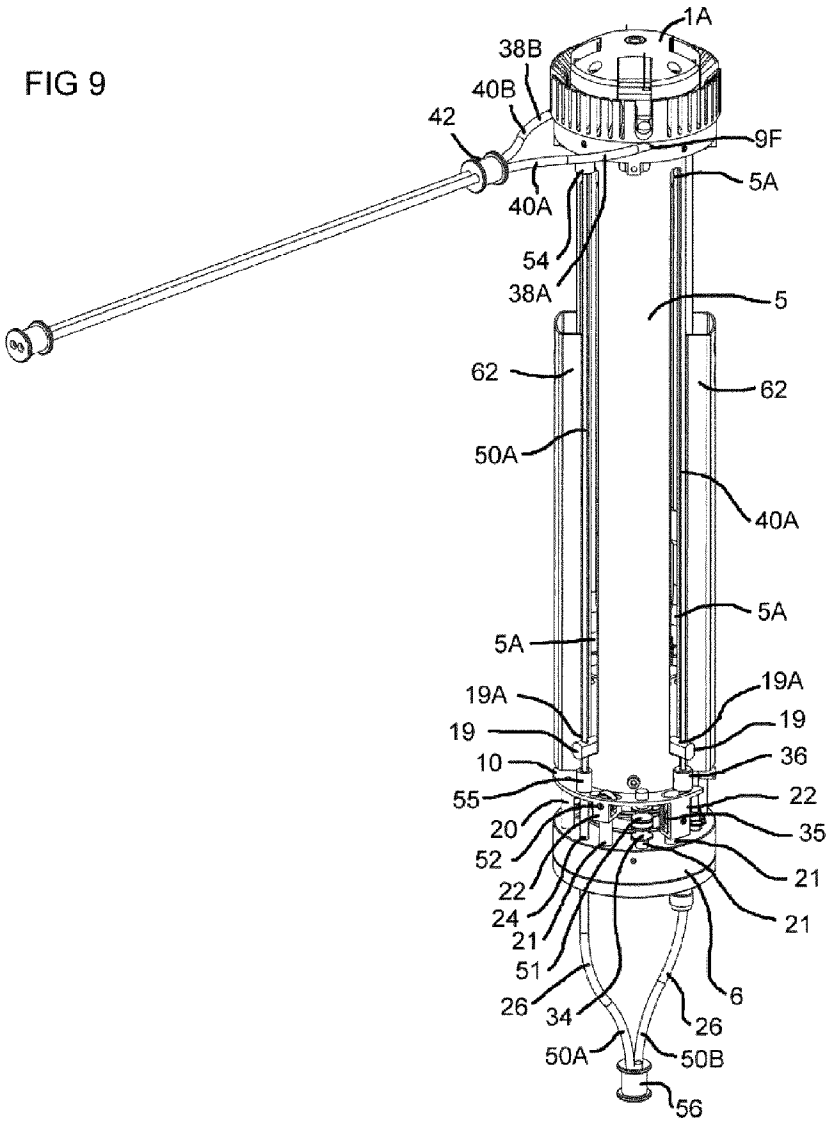
FIG. 9 is a perspective of the antenna assembly in a stowed configuration without the outer housing to illustrate the pull cord mechanism.

The lower mounting 4B defines slots 4C through which the coaxial cables (not shown) pass in order to run up through the central support 4 to the driven members 2. Mounted to lower mounting 4B are four locking pins 19 (three shown in FIG. 6) which extend radially outward from the mounting 4B. Each locking pin 19 defines a vertical through hole 19A. As illustrated in FIGS. 9 and 10, when the antenna is assembled with the inner housing 5, each locking pin 19 extends through a longitudinal slot 5A in the housing 5.

Figure 8:
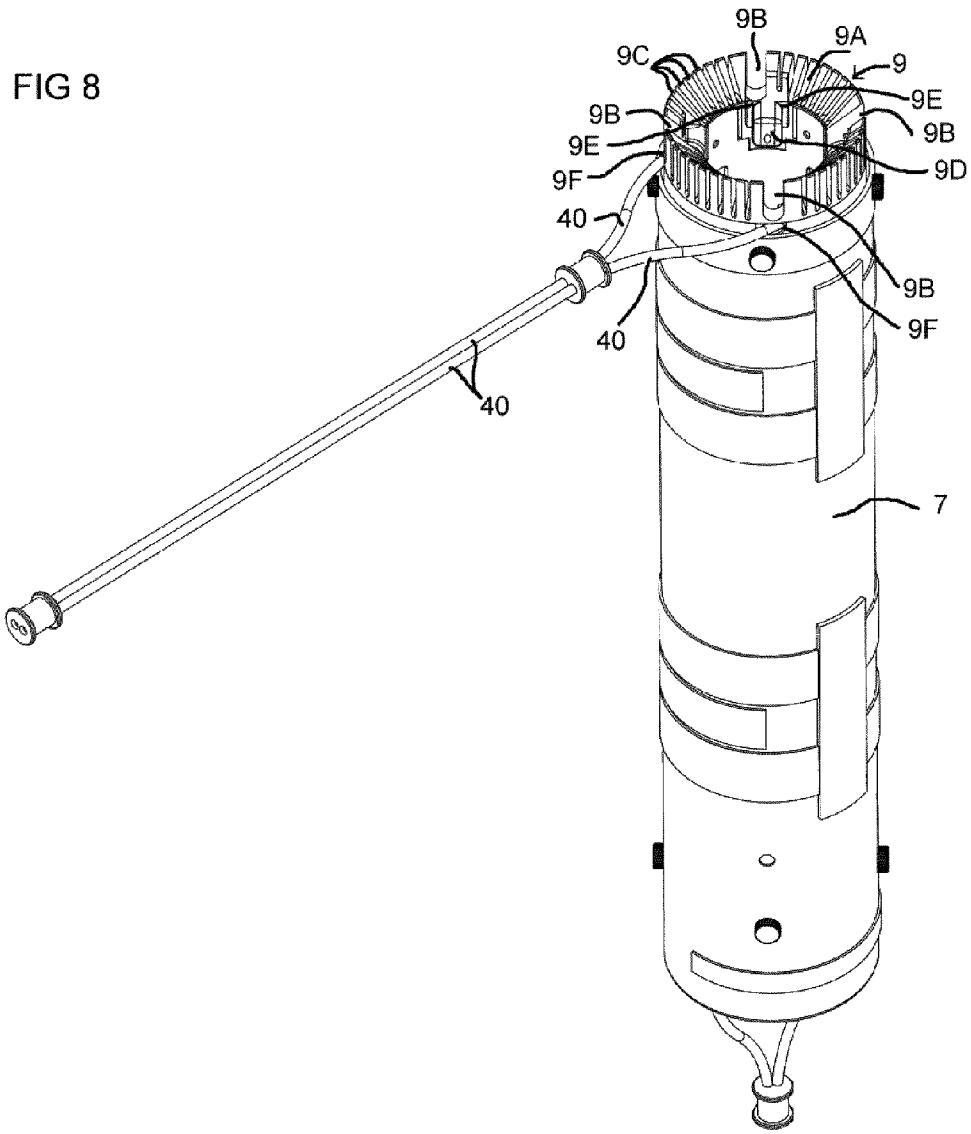
FIG. 8 is perspective of the housing of the antenna assembly.

As seen in FIG. 8, end cap 9 of the inner housing 5 has an inwardly sloping inner wall 9A. The wall defines four slots 9B through with ground plane members 3 extend when in an operational configuration. The wall 9A optionally defines a series of smaller slots 9C to reduce the build up of dirt and sand. Associated with each slot 9B is a recess 9D in the inner wall of the end cap 9B. Extending from either side into each recess 9D are camming surfaces 9E.

The end cap 9 also comprises two apertures 9F through which two ends of a pull-cord 40 pass out of the antenna assembly 1.

In a deployed state, the knuckles 13 are housed in corresponding recesses 9D of the end cap 9 with outer portions 13A resting against the camming surfaces 9E, and the ground plane members 3 extending radially away from the central support 4 through slots 9B.

To stow the antenna 1A into the inner housing, a downward force is applied to central support 4. The reactionary force of the camming surfaces 9E against the outer portion 13A of knuckles 13, causes the knuckles 13 to rotate up about mounting hinges 15 (against the action of spring 18) which leads to the driven members 3 moving towards a vertical orientation alongside the central support 4. The rotation of knuckles 13 draws the link bar 17 in a downward direction which in turn causes knuckles 14 to rotate about mounting pivots 15 so that driven members 2 are rotated downwards towards a vertical orientation as illustrated in FIG. 6.

Figure 12:
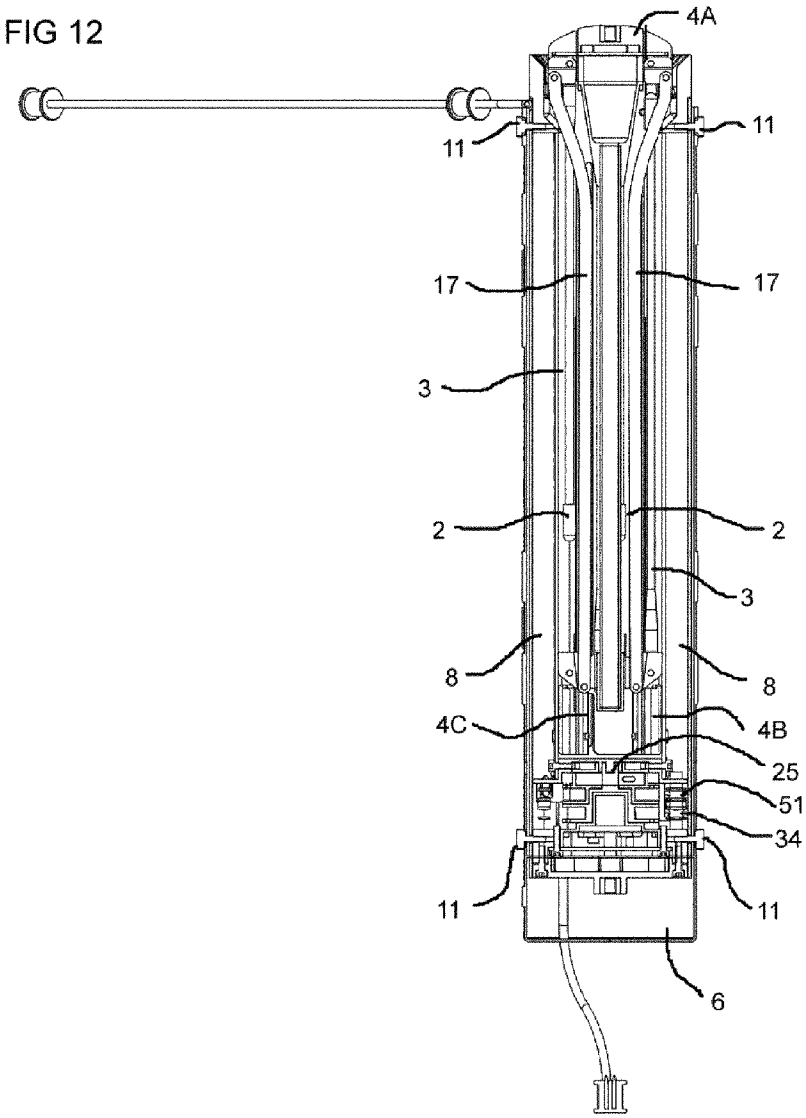
FIG. 12 is a side sectional view of the stowed antenna assembly.

Once the knuckles 13 of the ground plane members 3 have been rotated, neither the outer portions 13A, the ground plane members 3 or the driven members 2 extend beyond the outer periphery of the lower mounting 4B, thus allowing the antenna 1A to pass into and be stowed within the lower housing 5 as shown in FIGS. 9 and 12.

The inwardly sloping inner wall 9A acts to guide driven members 2 inwardly towards the central support 4 in the instance that they have not folded inwardly enough to avoid contact with upper cap 9.

When it is wished to deploy the stowed antenna 1A, an upward force exerted on the antenna 1A draws it out of the lower housing 5 through end cap 9. Once the antenna 1A has passed sufficiently out of the inner housing 5, the ground plane knuckles 13 are free to rotate under the biasing action of springs 18, towards a radial orientation until outer portions 13A of the knuckles 13 abut engagement surfaces 9E. The biasing action of springs 18 is sufficiently strong that, once the upward force is removed, the knuckles 13 are prevented from rotating inward by the weight of the antenna 1A so that the antenna 1A remains seated on top of end cap 9.

To provide means to stow and deploy the antenna 1A from the inner housing 5, the antenna assembly 1 is provided with a pull cord mechanism described below.

Provided at the lower end of the inner housing 5 is a bottom cap 10 to which the sealed enclosure 6 is mounted by downwardly extending mounting spigots 20. Also extending between the bottom cap 10 and enclosure 6 are mounting spigots 21 for supporting pulleys 34, 35, 51, 52. Some of these spigot 21 incorporate mounting brackets 22 for pulley wheels 35, 52 arranged to rotate about an axis running normal to the spigot 21. Also provided are guide spigots which act as cord guides 24, and a central spigot 25 shown in FIG. 12.

Figure 13:
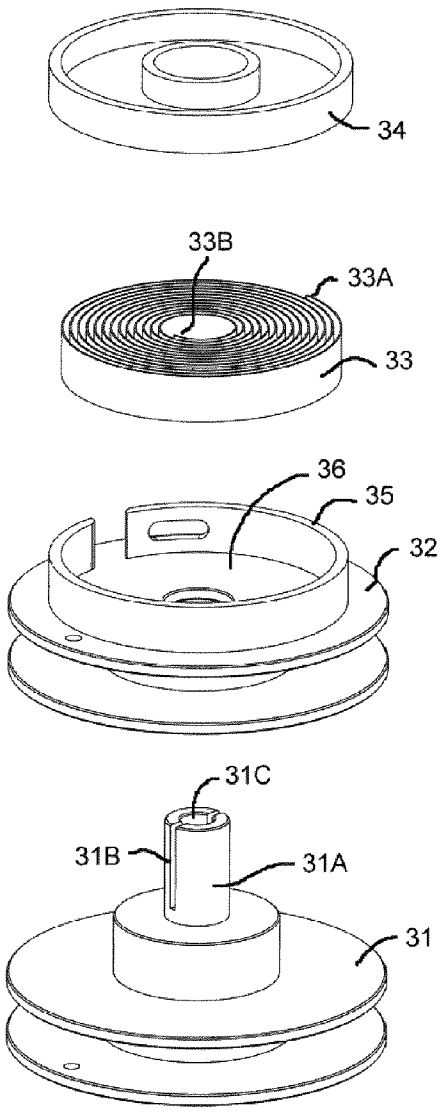
FIG. 13 is a perspective exploded view of the spool assembly.
Figure 14:
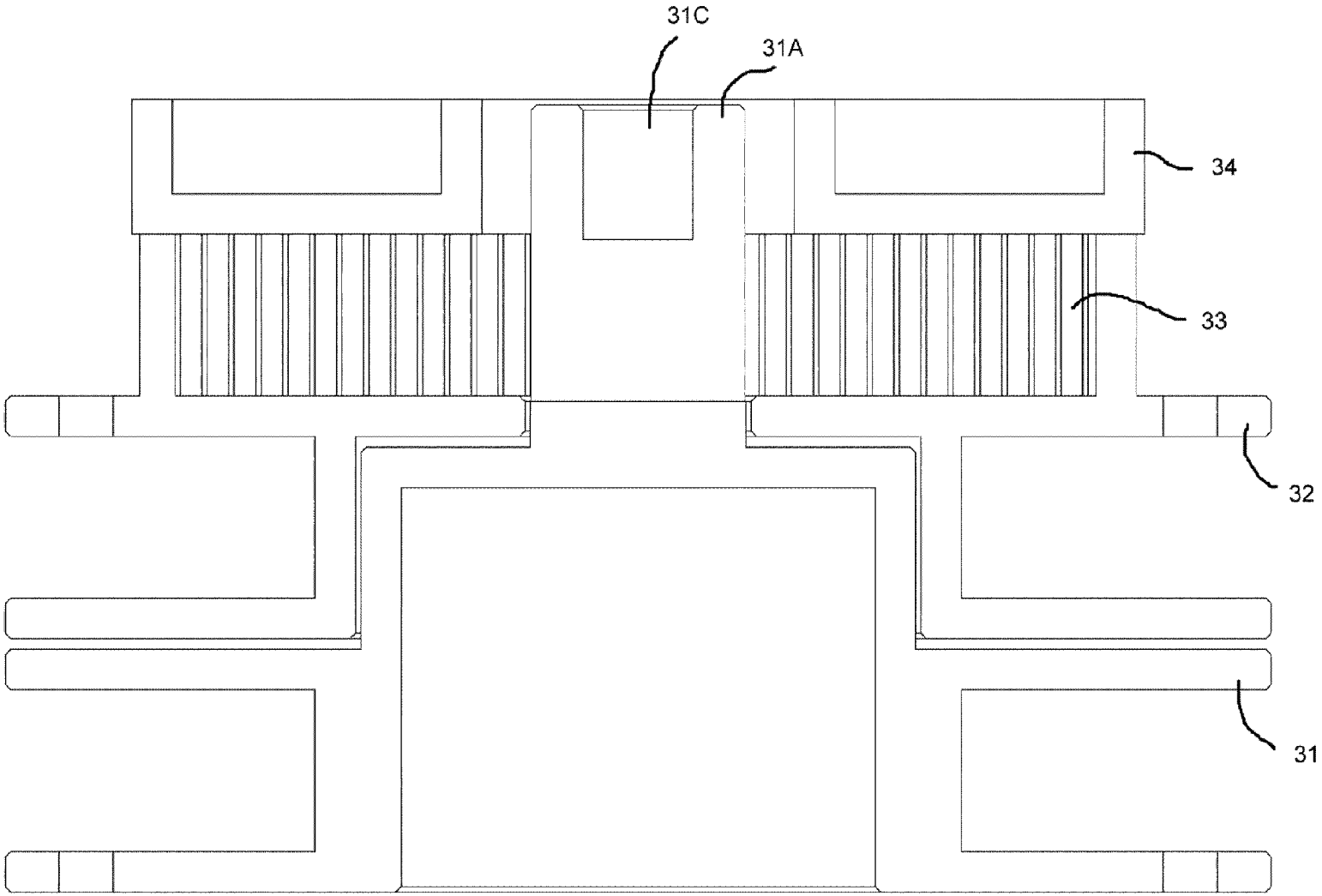
FIG. 14 is a side sectional view of the spool assembly.
Figure 15:
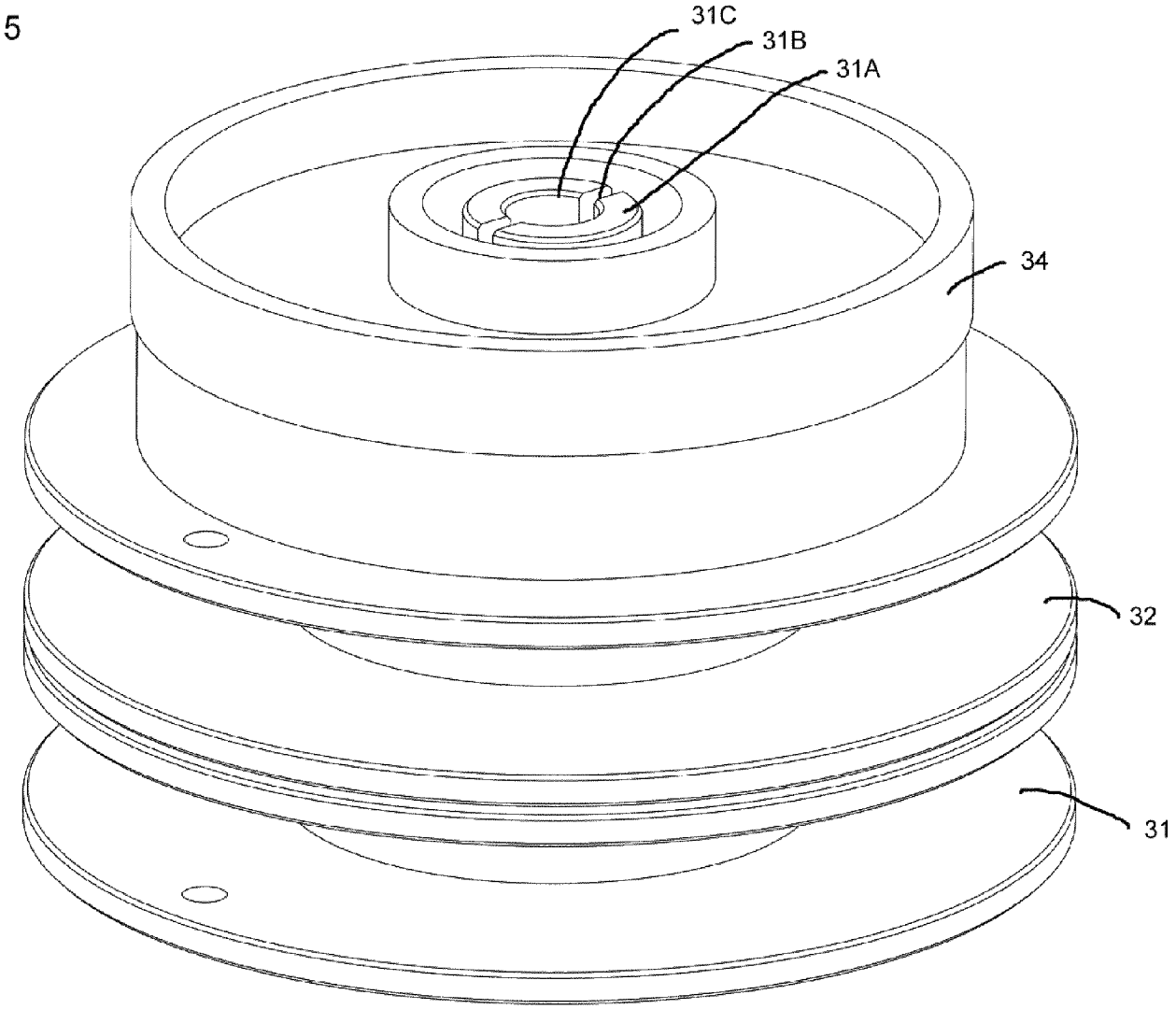
FIG. 15 is a perspective view of the spool assembly.

Seated between the end cap 10 and PCB enclosure 6 is spool assembly 30. The spool assembly 30, as illustrated in FIGS. 13-15 comprises two co-axial spools 31, 32, a spiral spring 33 and a retainer 34. The assembly is arranged to allow the spools 31, 32 to rotate relative to the end cap 10 and PCB housing 6, and each other.

In detail, first spool 31 is mounted over spigot 6A which extends upwardly from the PCB housing 6 in vertical alignment to central spigot 25. Spool 31 itself comprises a spigot 31A onto which second spool 32 sits and can rotate relative to the first spool 31 or vice versa. A circumferential flange 35 of second spool 32 extending from a face opposing the first spool 31 provides a housing 36 for spring 33. The spring 33 is retained within the housing by retainer 34.

The outer end 33A of the spiral spring 33 is secured to flange 35. The inner end 33B of spiral 33 is secured, by way of slot 31B to spigot 31A of the first spool 31 which, extends through second spool 32 and into housing 36. With this arrangement, rotation of either the first or the second spool relative to the other, will cause the spring 33 to be tightened or unwound.

To maintain vertical alignment, spool assembly 30 is retained by the central spigot 25 which engages in a vertical opening 31C in spigot 31A.

Onto the first spool 31 is wound a first cord 40 used to deploy the antenna 1A. The cord 40 is held on spool 31 so that both ends of the cord 40 are wound around the spool 31 in the same direction (hand).

A first pulley 34 takes a first end 40A of the cord 40 off the spool 31, a second pulley 35 rotates the cord 40A by ninety degrees, the cord 40A runs upwards parallel with the inner housing 5, through a bead 36, through an aperture 19A of a locking pin 19, and up to third pulley 37 mounted to a top end cap 9 which turns the cord 40A by ninety degrees. The cord 40A passes out of aperture 9F in the upper cap end 9 via a guide tube 38A secured to the upper cap end 9. The guide tube 38A reduces wear and the chance of the cord snagging against the end cap 9.

A substantially identical arrangement (not shown) of pulleys on the other side of the inner casing 5 (not shown in FIG. 9) takes the second portion 40B of the cord 40 off the spool 31 and rotates the cord 40B by ninety degrees. As before, the cord 40B runs upwards, parallel with the inner housing 5, through an aperture 19A of an opposing a locking pin 19 and up to a pulley 37B mounted to a top end cap 9 which turns the cord 40 by ninety degrees. The cord 40 then passes out of aperture 9F in the upper cap end 9, via a guide tube 37B where it is brought together with the first end 40A with a toggle 42. Both first 40A and second 40B portions of cord 40 are attached to a fabric looped handle 39 to ease grabbing and pulling of the cord 40. The cord 40 is guided through loops 42 on one of the shoulder straps of the rucksack 100 in order that the handle 39 hangs next to the soldier's S shoulder/chest where it is in easy reach.

In an operation to erect the antenna 1A from a stowed configuration, a pulling force on handle 39 (FIG. 17) causes both portions 40A, 40B of cord 40 to be unwound from the spool 31. Beads 36A, 36B which are fixed to their respective cord portions 40A, 40B are drawn upwardly to engage with the respective locking pins 19, whereupon further upward motion urges the locking pins 19 upwards along longitudinal slots 5A, and the central support 4 to which the locking pins are mounted, upwards through end cap 9. Once knuckles 13 have been raised into the end cap 9, spring 18 causes the ground plane members 3 and driven members 2 to open out as described above. Excess upward motion of the antenna 1A is checked by engagement of locking pins 19 against stoppers 41.

Once the antenna 1A is erected and the pull handle is released, spring 33 recoils, causing the first spool 31 to rotate to redraw the cord 40. This can be achieved without causing the antenna 1A to withdraw into housing 5 as cord portions 40A, 40B are free to pass through aperture 19A of the locking pins. The cord 40 is redrawn until bead 36 engages against lower end cap 10.

Onto the second spool 32 is wound a second cord 50 used to collapse and stow the antenna 1A into housing 5. The cord 50 is held on spool 32 with both ends of the cord 50 wound around the spool 32 in the same direction (hand). Cords 40 and 50 are wound in opposite directions on their respective spools 31, 32.

A forth pulley 51 takes a first end 50A of second cord 50 off the spool 32, a fifth pulley 52 rotates the cord 50 by about ninety degrees so that it runs upwards towards the upper end cap 9. A sixth pulley 53 mounted to the upper end cap 9 turns the cord 50A through one-hundred-and-eighty degrees. Cord 50 runs back down towards the lower end cap 10 passing though aperture 19A of locking pin 19. A bead 54 is mounted to cord 50 at a point above the locking pin 19. The cord 50 passes through stop 55 through spigot 24, and passes into guide tube 26 which runs through the PCB housing. The cord 50 passes out through the bottom of the PCB housing 6.

A similar arrangement of pulleys (not shown) guides the second portion 50B of the second cord 50 in a likewise fashion on the otherwise of the inner housing 5. The first and second portions of the second cord 50 are brought together by toggle 56. Both ends of the first and second portions of second cord 50 are attached to a fabric looped handle 57 to ease grabbing and pulling of the cord 50.

As illustrated in FIGS. 1 & 2 handle 57 is arranged to hang below the antenna assembly 1 in easy reach of one of the soldier's hands.

In an operation to stow the antenna from a deployed state, a pulling action on handle 57 (FIG. 16) causes the first and second portions 50A, 50B of cord 50 to be unwound from spool 32. Beads 54 secured to the respective first and second portions (in this instance with a grub screw) are drawn downwards into engagement with locking pins 19, whereupon further downward motion of the beads 54 urges the locking pins 19 to move downwardly along slots 5A. This provides the aforementioned downward force which causes the knuckles 13 to rotate and the antenna 1A to withdraw into the inner housing 5 as previously described.

Once the antenna 1A is stowed and the pull handle 57 released, spring 33 recoils causing spool 32 to rotate in the opposite direction to wind the cord 50 back onto the spool 32. During this action the pull handle 57 is drawn back towards the antenna assembly 1. The beads 54 mounted to cord portions 50A 50B travel up until they engage with the upper cap 9 which stops further recoiling of the cord 50.

As mentioned above, running between the PCB housing 6 and the driven members 2 are two coaxial cables (not shown). To ensure the coaxial cables do not interfere with the operation of pull-cord mechanism, they run along the outside of the inner housing 5 through guards 61, 62 spaced between the pairs of cords 40A, 50A and 40B, 50B. The guards 61, 62 also hold slack co-axial cable when the antenna 1A is in a stowed configuration.

Figure 18:
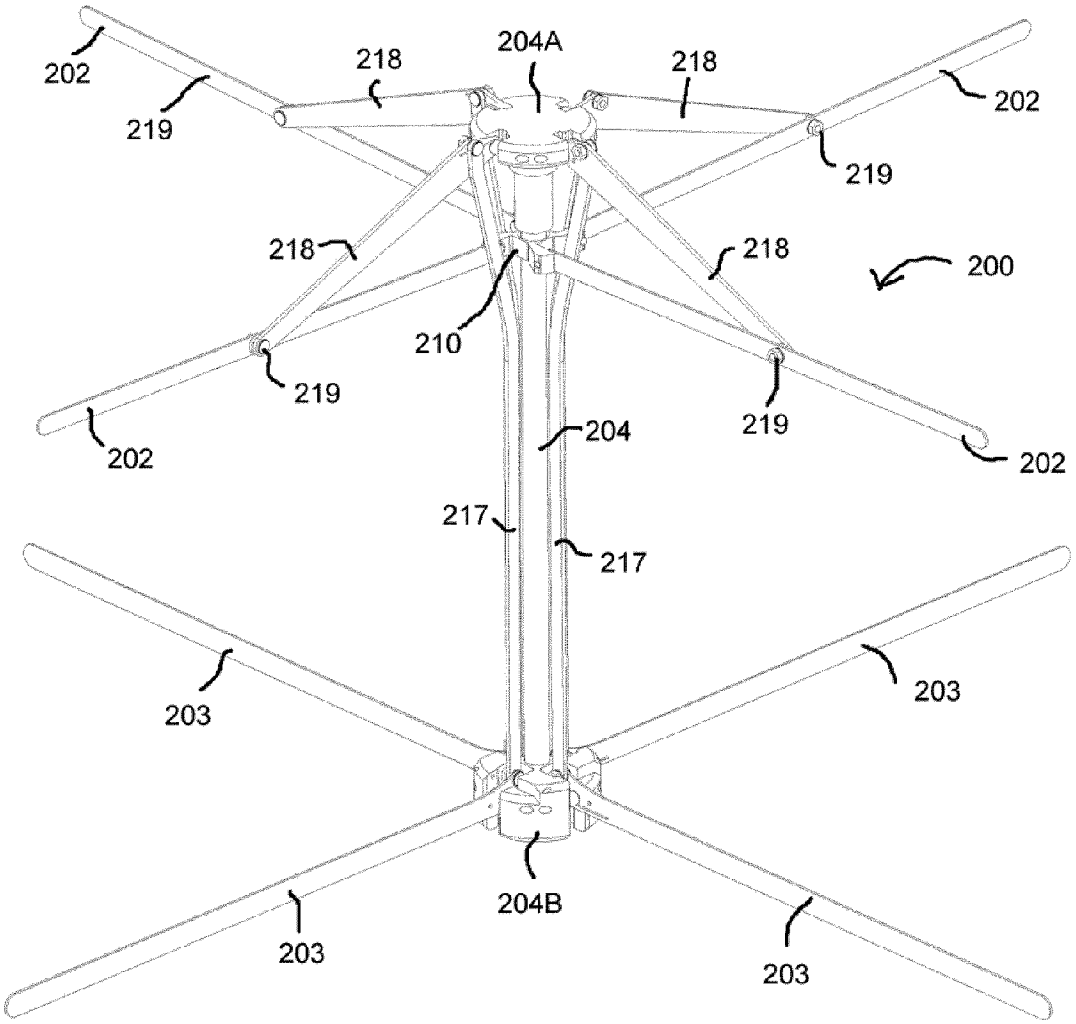
FIG. 18 is a perspective view of an alternative embodiment of an antenna shown in a deployed state.
Figure 19:
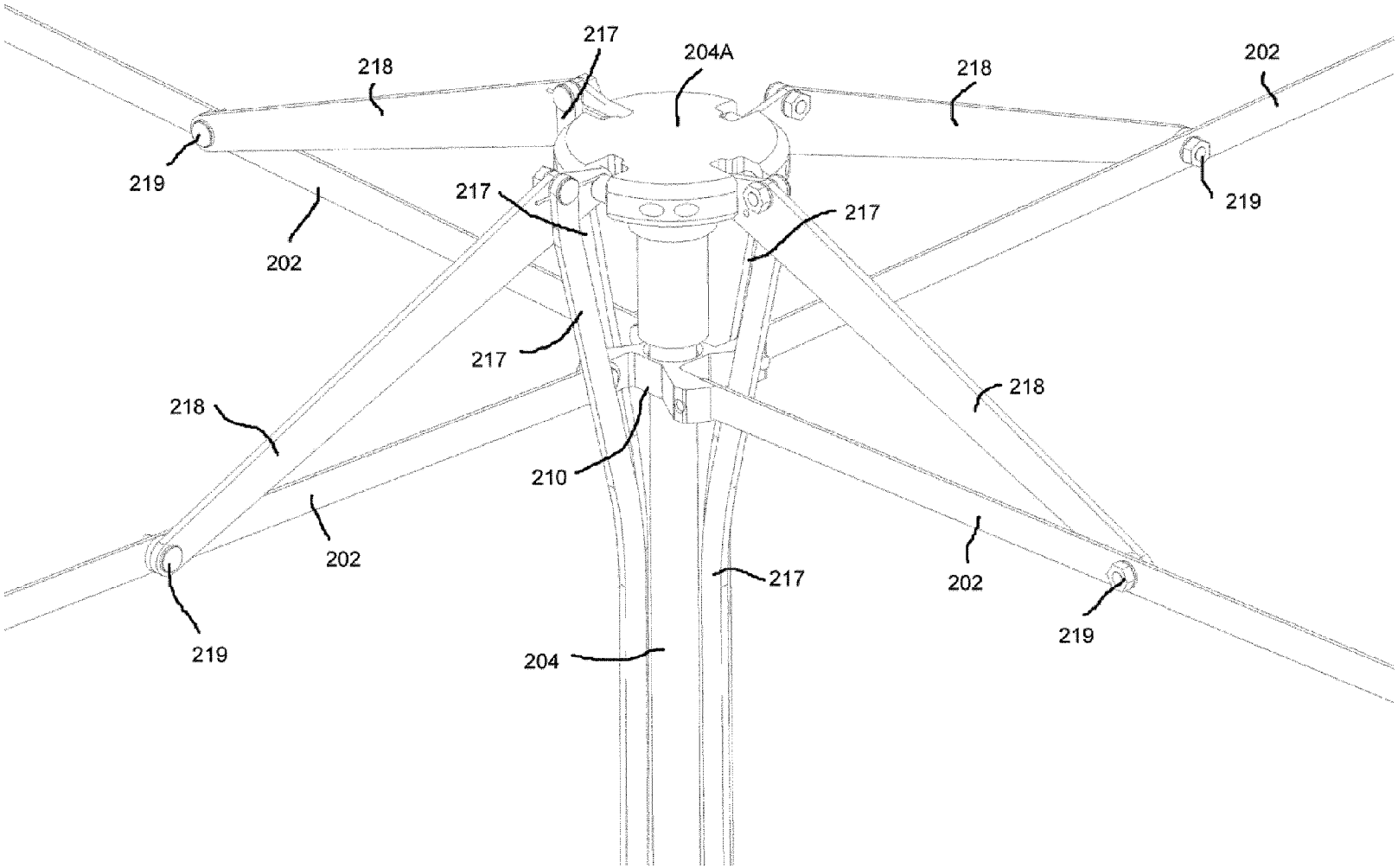
FIG. 19 is a close perspective view of the antenna of FIG. 19.

FIGS. 18 & 19 illustrate an alternative design of antenna 200 for use with the above described antenna assembly 1.

As before, antenna 200 comprises driven members 202, ground plate members 203, both mounted to a central support 4. The design of the antenna 200 differs in that rather than being hinged directly to the central support, each of the driven members 202 are hinged to an annulus 210 which passes round the central support 204. The upper end of each link bar 217 is hingedly mounted to arm 218 which itself is hinged at its inner end to the upper mounting 204A. The opposing end of each arm 218 is connected to a driven member 202 by hinge 219. When the erect antenna 200 is drawn into housing 5 during a stowing operation, the ground plane members 203 are caused to rotate upwardly as before and draw the link bar 217 downwards. The drawing force on the link bar 217 is transferred through arm 218 causing driven members 202 to pivot about hinge 219 such that the annulus 210 slides downwardly along the central mounting 204 towards lower mounting 4B. As the annulus 210 moves downwards, arm 218 rotates about its hinged connection to upper mounting 204A, and hinge 219 is drawn towards the central support 204. The driven members 2 are caused to rotate towards a vertical orientation with the ends that were radially distant of the central support uppermost.

Variations on the above described designs are possible. For example rather than using two ends of a single pull cord 40, each end could be provided by a separate cord, both being anchored to the spool and wrapped around it in the same direction.

Cords 40, 50 could be comprised from other flexible elongate members, examples include, but are not limited to ropes, cables, rods or chains. Similarly the linkage 17 may take forms other than a bar.

The knuckles 13, 14 may instead be integral part of the ground plane members. This arrangement is used in the embodiment shown in FIGS. 18 and 19.

FIGS. 20-27 illustrate a further variant embodiment having a simplified deployment mechanism. Much of the assembly is very similar or identical and so the following description focuses primarily on the differences. As before, the assembly 301 comprises an antenna assembly 301A arranged to be drawn into and out from a housing. The housing comprises: an inner housing 305 (FIG. 23) that holds the antenna 301A when stowed; a sealed casing 306 housing the circuitry for driving the antenna; the inner housing 305 and casing 306 are housed within an outer housing 307. A spacing 308, between the outer housing 307 and inner housing 305 carries coaxial cabling between the antenna 301A and the circuitry within casing 306. The space 308 also houses a pull-cord 340 in the form of a strap of webbing. The outer housing 307 is held within a fabric bag 350 (see FIG. 21). Extending from either side of the bag 350 are cord guides (to allow use by left or right handed users) comprised from tongues 351 with eyelets 352 and hook/loop fastener straps 353 to secure the guide to a jacket worn by the user.

The end cap 309 of inner housing 305 as before has an inwardly sloping wall 309A (seen best in FIG. 26) for engagement with knuckles 313 of ground plane members 303 so as to cause rotation of the ground plane members when the antenna 301A is drawn into the housing 305. Unlike the previous embodiment the end cap 309 is not provided with slots.

A part of the lower mounting 304B of antenna 301A provided with diametrically opposed apertures 304C is housed within housing 305. Pins 319A 319B (see FIG. 26) extend through diametrically opposed longitudinal slots 305A in inner housing 305 and through apertures 304C of lower mounting 304. It would be of course possible to use only a single pin.

A single pull cord 340 is anchored, at a point intermediate between its ends, to pin 319A within space 308. A first portion 340A of cord 340 runs upwardly from pin 319A, substantially parallel with housing 5A, over a roller pulley 337 mounted to a top part of housing 305 and/or end cap 309, and then out through an aperture of outer housing 307.

Figure 20:
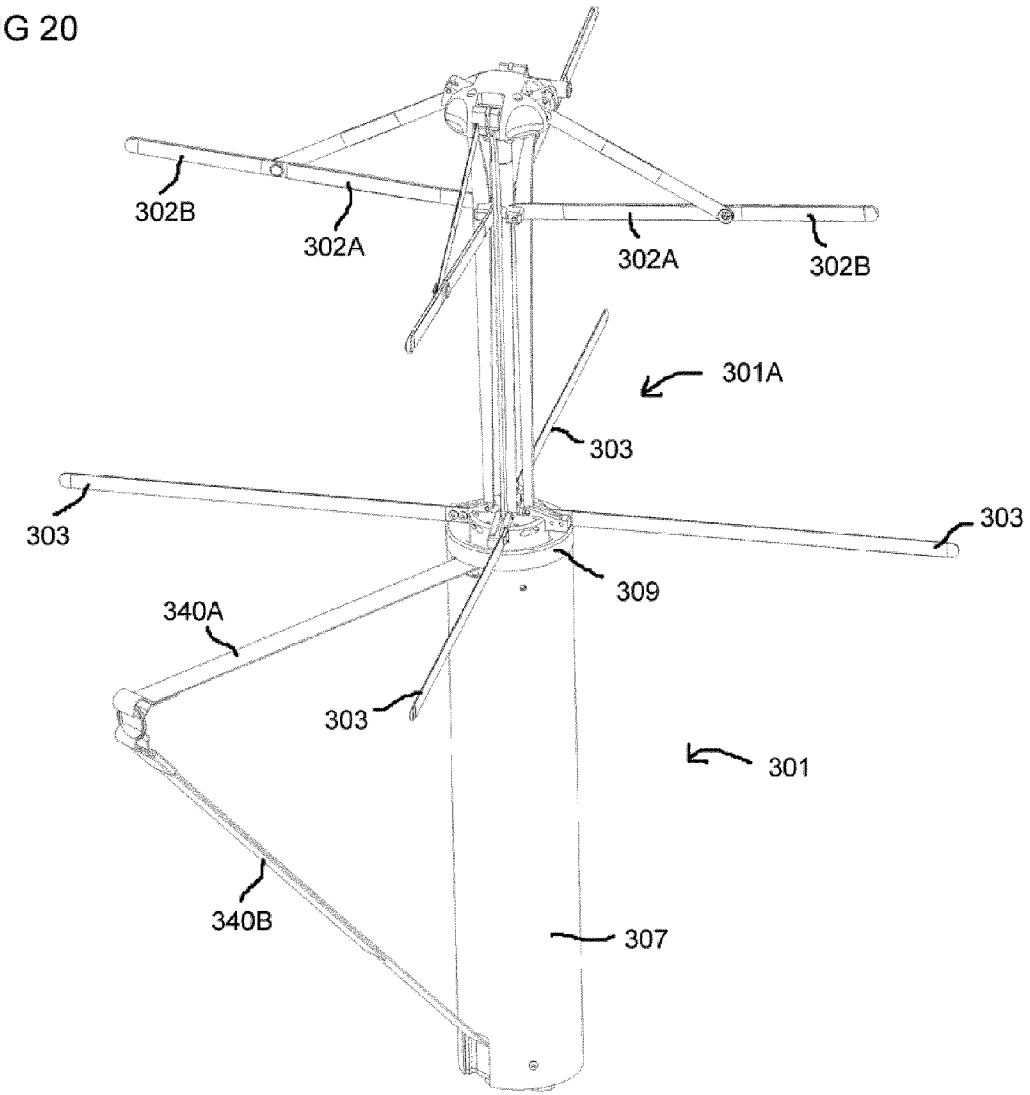
FIG. 20 is a perspective view of an alternative embodiment of deployed portable antenna assembly shown in a deployed configuration.
Figure 21:
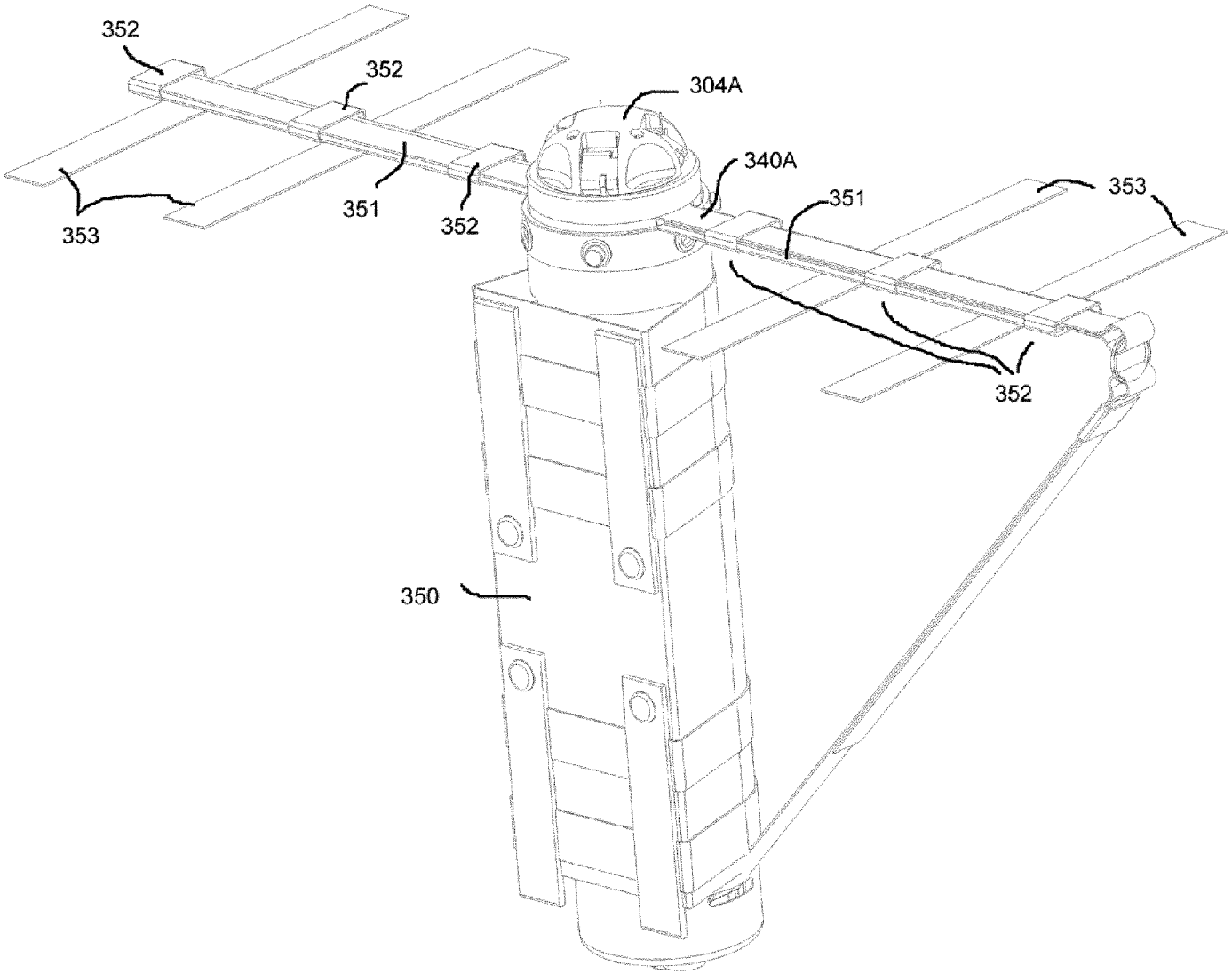
FIG. 21 is a perspective view of the antenna assembly of FIG. 20 taken from the opposite side with the antenna in a stowed configuration and housed in a fabric bag.
Figure 22:
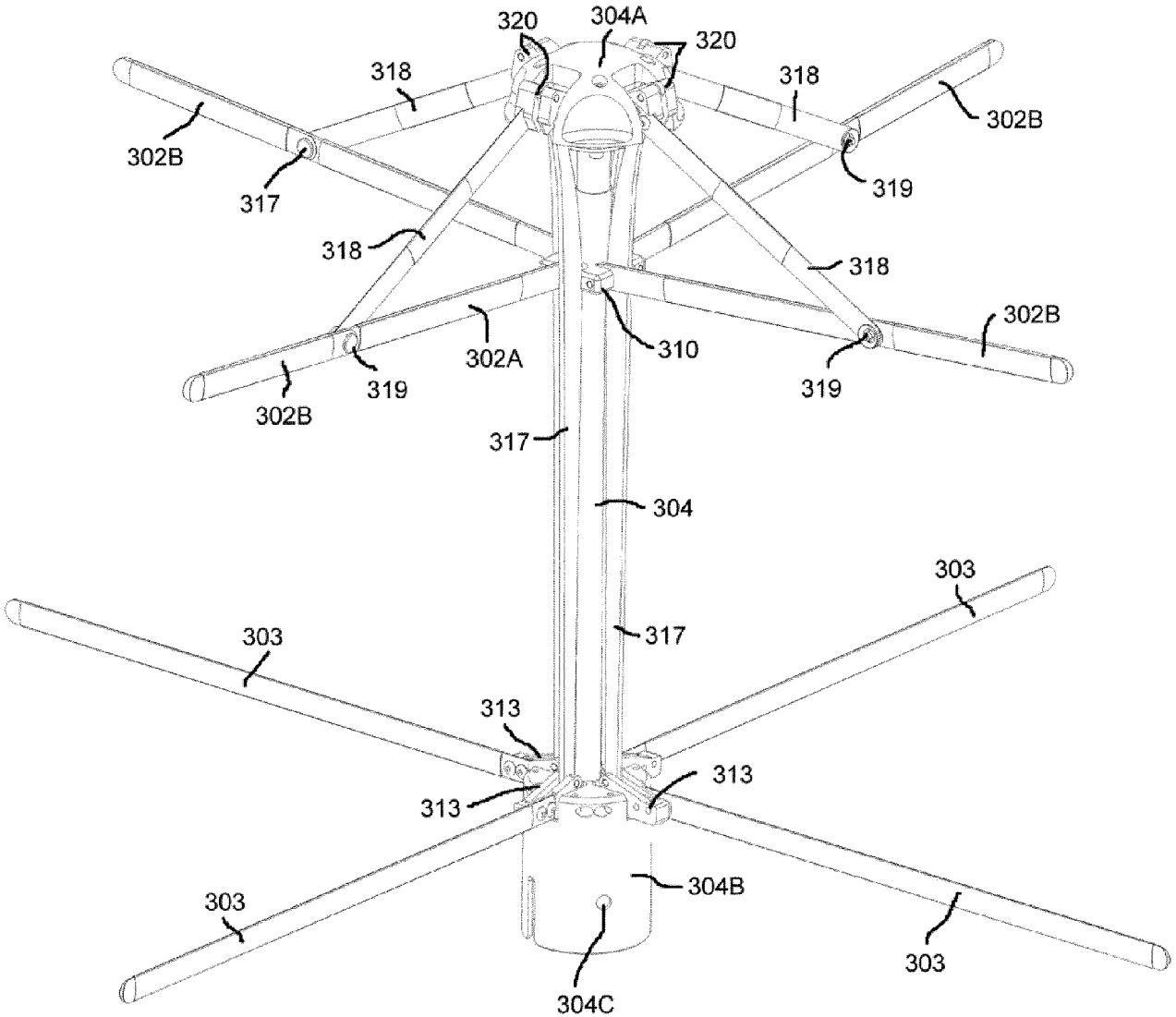
FIG. 22 is a perspective view of the antenna of FIG. 20 in a deployed configuration.
Figure 23:
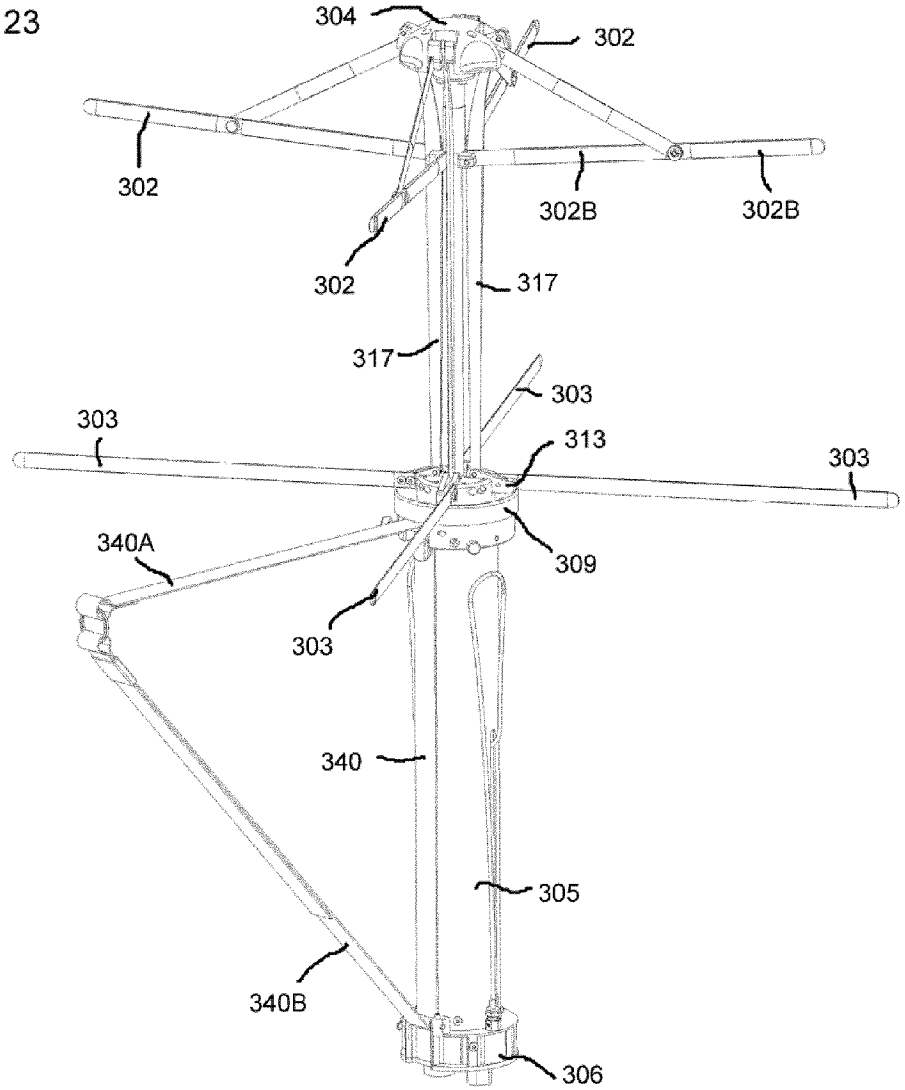
FIG. 23 is a perspective view of the alternative embodiment antenna assembly without outer housing.
Figure 24:
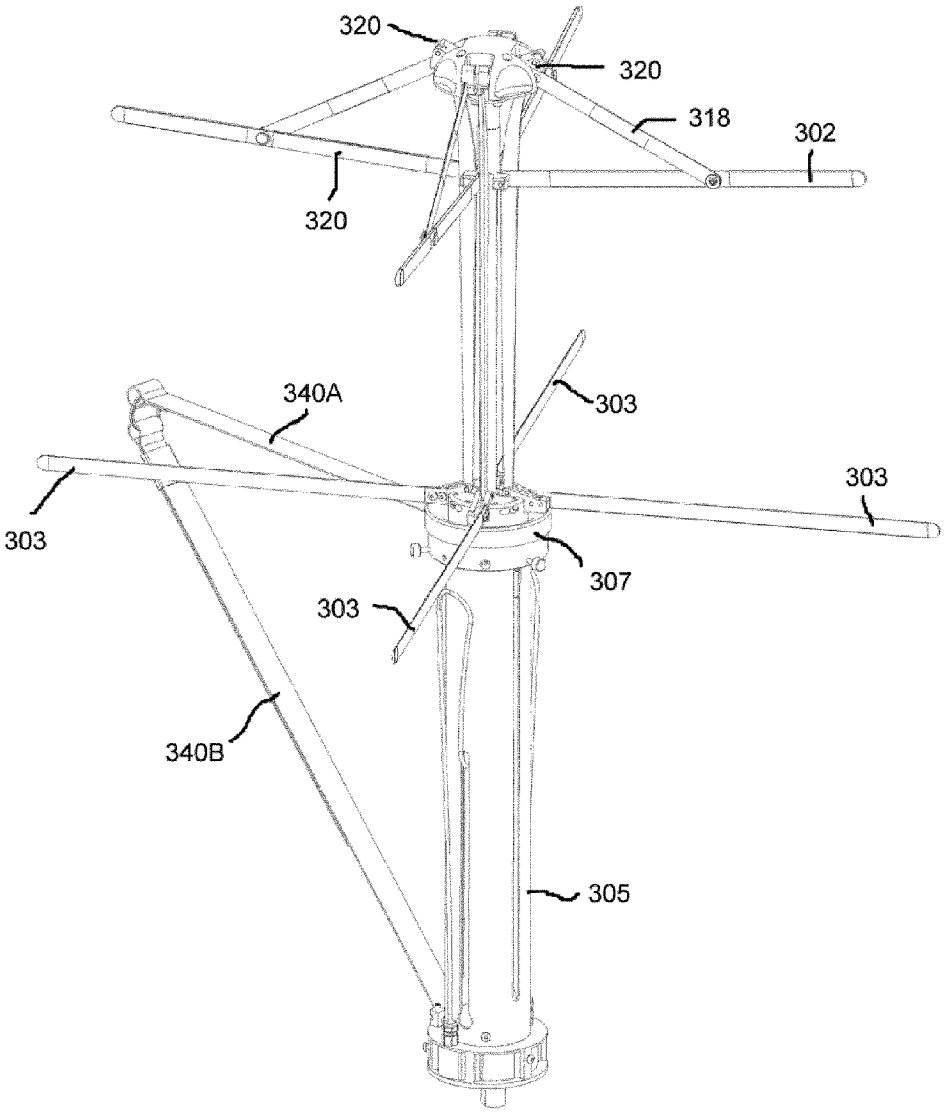
FIG. 24 is a perspective view of the alternative embodiment antenna assembly without outer housing shown from a different vantage.
Figure 25:
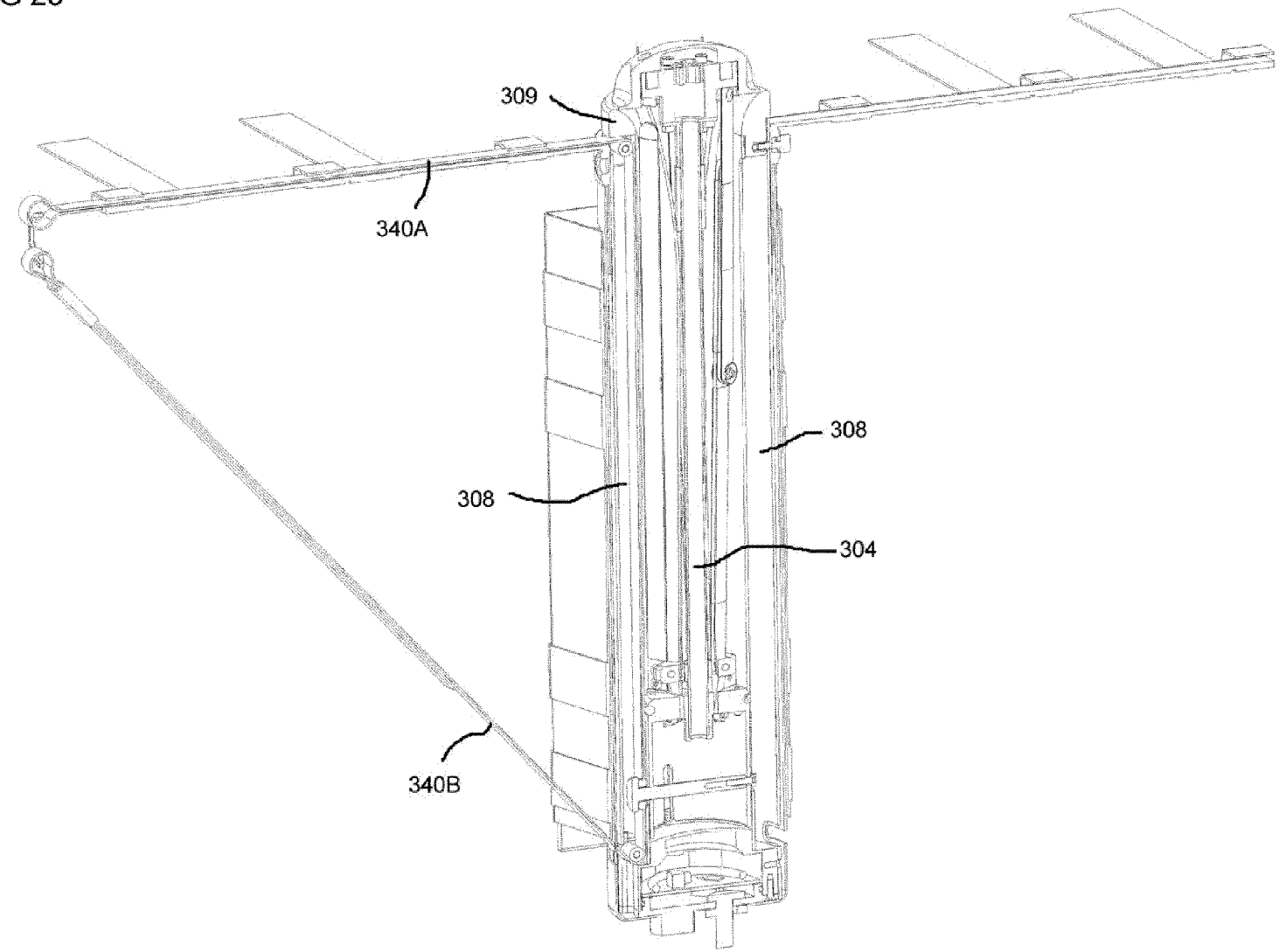
FIG. 25 is a cross section view of the alternative embodiment antenna assembly in a stowed configuration.
Figure 26:
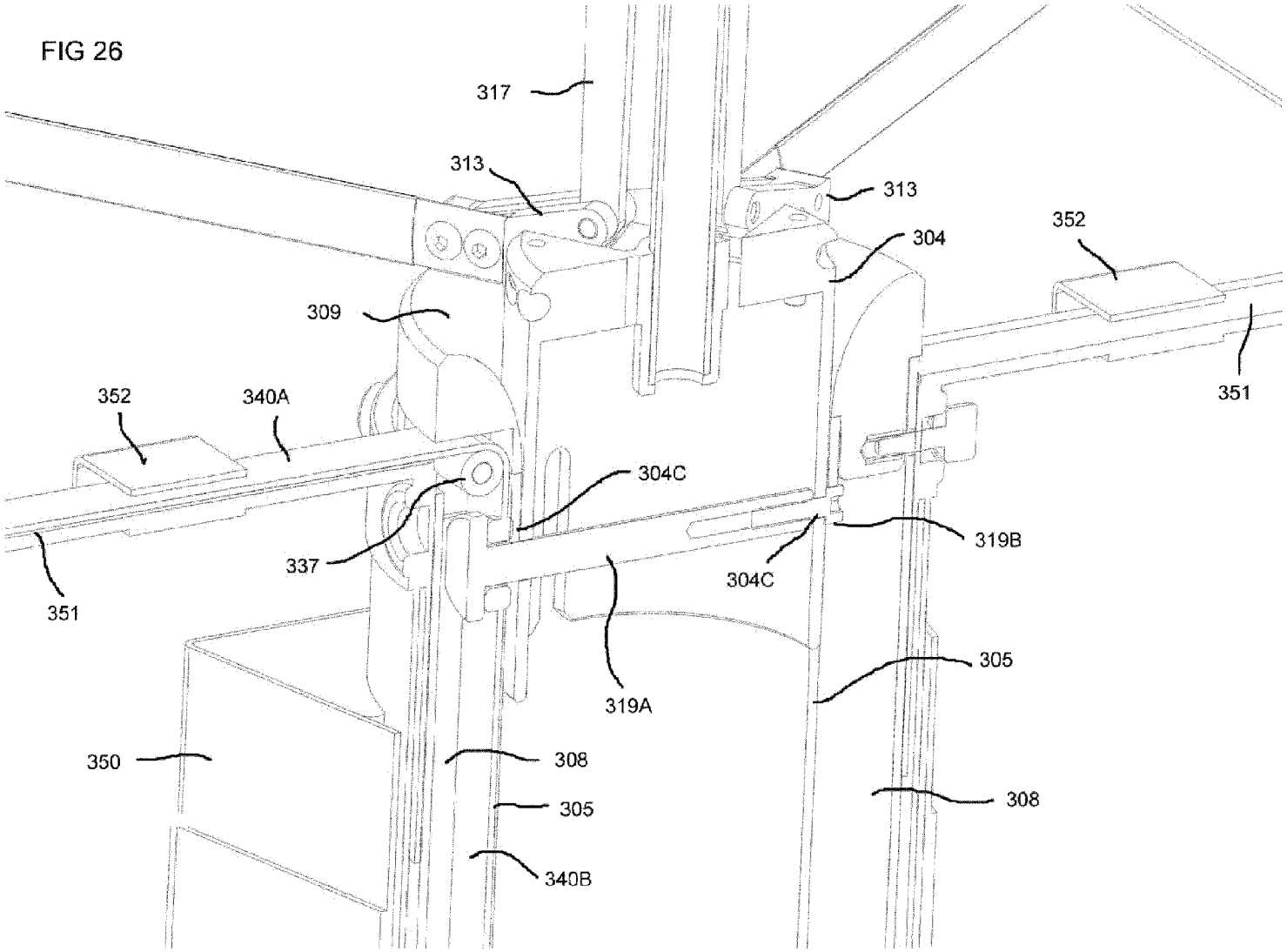
FIG. 26 is a cross section view of the alternative embodiment antenna assembly in erected configuration showing in close up the upper roller, and pin that is anchored to the cord and antenna.
Figure 27:
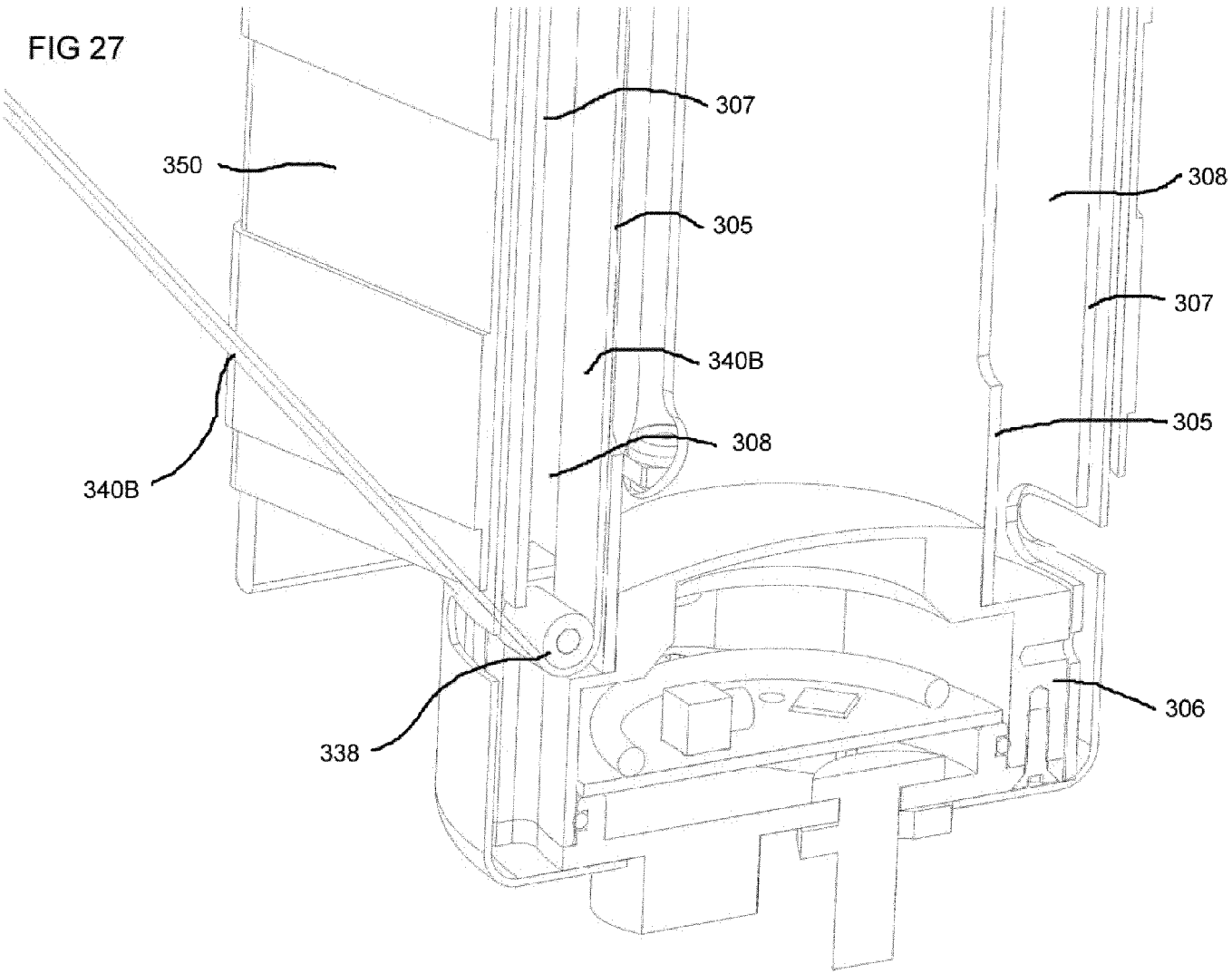
FIG. 27 is a cross section view of the alternative embodiment antenna assembly in erected configuration showing in close up the lower roller.

A second portion 340B of cord 340 extends away from the pin 319A in the opposite direction substantially parallel with outer wall of housing 305A, over a roller pulley 338 (see FIG. 27) mounted to lower part of housing 305 or casing 306, and then out through a lower aperture of outer housing 7. The free end of the cord 340A passes over tongue 351 through eyelets 352 to guide the end of the cord 340A to a convenient position to be reached and operated by the user. The ends of the cord 340 may be provided with straps (as in the earlier embodiment or linked/tied together to form a loop as shown in FIG. 20.

In an operation to stow the antenna 301A from a deployed state, a pulling action on the second portion 340B causes the pin 319 to be drawn downwardly along slot 305A. This acts upon the antenna 301A drawing it downwardly into housing 305. The action of the knuckles 313 against the upper portion 309 of housing 305 causes the antenna 301A to collapse in a manner similar to that afore described.

The arrangement of the antenna 301A is similar to that of FIGS. 18 and 19, but with the upper end of linkage element 317 being hinged to elbow joints 320 rather than directly to arm 318 which are themselves hinged to upper mounting 304A. Arms 318 are rigidly mounted, at their upper end, to elbow joints 320. The opposing end of each arm 218 is hingedly connected 319 to lateral members 302. The radially inward end of lateral members 302 are connected to a ring 310 mounted over stem of support 304.

A drawing force on the link bar 317 causes elbow joint 320 to rotated which in turn causes arm 302 to rotate about elbow joint 320. This in turn causes the lateral member 302 to pivot about hinge 319 such that the ring 310 slides downwardly over the stem 304 towards lower mounting 304B. As with the embodiment shown in FIGS. 18, 19, the lateral members 302 are caused to rotate towards a vertical orientation with the ends that were radially distant of the central support 304 uppermost.

The driven elements of the antenna 301A are comprises from directly opposing pairs of arm 318 and corresponding lateral member 302. The coaxial cable extending from the circuitry in housing 306, is electrically connected to the elbow joint 320. The elbow joint 320 and arm 318 are comprised from good electrical conductors, such as nickel, and are in electrical contact. The lateral member 302 has a radially inner portion 302A and a radially outer portion 302B formed from spring metal. The radially outer portion 302B is in electrical contact with arm 318 through hinge 319. The radially inner and outer portions 302A, 302B are interposed by a central portion formed from an electrical insulator. The electrical insulator may be or comprised from a variety of materials, though glass plastics composite is preferred for its mechanical properties.

By electrically insulating the portion of the lateral member 302 which lies substantially directly under the arm 318, i.e. radially inwards of hinge 319, improved antenna performance has been observed. It would be possible to form the whole of radially inner portion 30A from an electrical insulator as well; however, use of spring metal gives the lateral member greater resilience to breakage.

In an alternative embodiment the first and second cord portions 340A, 340B may be provided by separate cords each anchored to the pin 319.

Variations on the above detailed embodiments are possible. For example, the antenna 1A may comprises more or less than four laterally extending members acting as the driven element(s), and more or less than four ground members.

When used in systems such as TACSAT it is preferred that the antenna has circular polarisation, though the invention may be used with an antenna having another polarisation.

The driven element(s) need not collapse inwardly towards the support. Rather, the support may be substantially drawn into the housing leaving the driven element to remain outside of the housing. This could be particularly beneficial for types of antenna having a shrouded driven element, and/or are mounted to the very top of the support 304A and cannot be collapsed.

The length of the portion 302B of the lateral member 302 radially outward of hinge 319 may vary depending on the radio frequency(s) at which the antenna is to be used. In certain embodiments the lateral member 302 may not appreciably extend radially outwards of the hinge 319.

It will be understood that use of the antenna may not be limited to military applications or used only by soldiers. Although shown mounted on a back pack, the device could equally be mounted on the ground or a vehicle.

The invention claimed is:

1. A man-portable antenna assembly comprising:

an antenna having at least one driven element mounted on a support: the driven element having an elongate member;

a housing in which the antenna is housed when stowed; and a mechanism configured to withdraw the antenna out from the housing when the antenna is to be used, the mechanism being configured to cause the elongate member to be extended away from or withdrawn towards the support.

2. A man-portable antenna assembly according to claim 1 wherein the housing is configured to serve as a mast for the antenna when withdrawn out from the housing.

3. A man-portable antenna assembly according to claim 2 wherein the antenna is supported on an upper end of the housing when in use.

4. A man-portable antenna assembly according claim 3 wherein the mechanism is configured to withdraw the antenna into the housing when the antenna is to be stowed.

5. A man-portable antenna assembly according to claim 4 wherein the driven element comprises:

an elongate member and wherein the mechanism is configured to cause the elongate member to be extended away from or withdrawn towards the support.

6. A man-portable antenna assembly according to claim 5 in which the mechanism comprises:

means which engage with the housing when the antenna is being withdrawn into the housing for causing the driven element to withdraw towards the support.

7. A man-portable antenna assembly according claim 6 wherein the driven element comprises:

elongate members which are foldably mounted to the support in order to fold away from or in towards the support.

8. A man-portable antenna assembly according to claim 7 wherein a ground plane comprises:

elongate members which are foldably mounted to the support in order to fold away from or in towards the support.

9. A man-portable antenna assembly according claim 1 wherein the mechanism is configured to withdraw the antenna into the housing when the antenna is to be stowed.

10. A man-portable antenna assembly according to claim 9 in which the mechanism comprises:

means which engage with the housing when the antenna is being withdrawn into the housing for causing the driven element to withdraw towards the support.

11. A man-portable antenna assembly according to claim 1 wherein the driven element comprises:

an elongate member and wherein the mechanism is configured to cause the elongate member to be extended away from or withdrawn towards the support.

12. A man-portable antenna assembly according to claim 11 in which the mechanism comprises:

means which engage with the housing when the antenna is being withdrawn into the housing for causing the ground plane to withdraw towards the support.

13. A man-portable antenna assembly according to claim 11 wherein a ground plane comprises:

elongate members which are foldably mounted to the support in order to fold away from or in towards the support.

14. A man-portable antenna assembly according to claim 13 comprising:

a bias which will cause the elongate members to fold outwardly away from the support when not retained in the housing.

15. A man-portable antenna according to claim 11 wherein both the driven element and a ground plane element are configured to be collapsed towards the support into a stowed configuration; the antenna comprising:

a linkage between the driven element and ground plane element for causing, when one of the driven element or ground plane element is collapsed, the other to also collapse.

16. A man-portable antenna assembly according claim 1 wherein the driven element comprises:

elongate members which are foldably mounted to the support in order to fold away from or in towards the support.

17. A man-portable antenna according to claim 1 wherein the mechanism is configured for operation by a pull-cord.

18. A man-portable antenna assembly according to claim 1, in combination with a radio for satellite communication.

19. A man-portable antenna assembly according to claim 1 comprising:

two dipoles orientated substantially perpendicular to one another; and at least four grounded radial elements which act as a reflector for the dipoles.

20. A man-portable antenna assembly comprising:

an antenna having driven elements mounted on a support;

a housing in which the antenna is housed when stowed; and a mechanism configured to withdraw the antenna out from the housing when the antenna is to be used; and wherein the antenna includes two dipoles orientated substantially perpendicular to one another, and a ground plane that acts as a reflector for the dipoles.

* * * * *